US006062942A

United States Patent [19]

Ogihara

[11] Patent Number: 6,062,942

[45] Date of Patent: May 16, 2000

[54] INTERACTIVE INTERSECTION FOR TOY TRACKS

[75] Inventor: Nobuaki Ogihara, Kawaguti, Japan

[73] Assignee: Asahi Corporation, Tokyo, Japan

[21] Appl. No.: 09/084,532

[22] Filed: May 26, 1998

[30] Foreign Application Priority Data

May 26, 1997 [JP] Japan ..... 9-134979

[51] Int. Cl.[7] ..... A63H 18/00; E01B 7/00

[52] U.S. Cl. ..... 446/444; 446/446; 246/415 A

[58] Field of Search ..... 446/444, 445, 446/446, 489, 431, 429; 104/251, DIG. 1; 105/1.5; 246/415 A, 465

[56] References Cited

U.S. PATENT DOCUMENTS 2,106,424 1/1938 Einfalt ..... 446/444 X

FOREIGN PATENT DOCUMENTS 467788 6/1937 United Kingdom ..... 446/444

673321 6/1952 United Kingdom ..... 446/444

2099712 12/1982 United Kingdom ..... 446/444

*Primary Examiner*—D. Neal Muir

*Attorney, Agent, or Firm*—H. C. Chan

[57] ABSTRACT

A rotation control unit is disposed on an intersection portion. The rotation control unit has a plurality of blocks and extends into a running way of an automotive toy. As an automotive toy enters an intersection from a running way, the automotive toy pushes a block to rotate a rotation control unit. Due to this rotation, the block is moved away from the running way and the automotive toy on the running way is made movable. A block is placed on the other running way to close it so that the other automotive toy is prevented from entering the intersection portion. While the automotive toy is passing the intersection, the rotation control unit retains this state. After the automotive toy has passed the intersection portion, the pressure applied to the block is removed and the rotation control unit is returned to its original position, whereby the automotive toy can enter the intersection portion from the other running way.

14 Claims, 19 Drawing Sheets

INTERACTIVE INTERSECTION FOR TOY TRACKS

BACKGROUND OF THE INVENTION

1. Field of the Invention

The present invention relates to an intersection apparatus for automotive toys, a toy track for automotive toys, a point control apparatus for automotive toys, and method of controlling automotive toys.

2. Description of the Related Art

When a plurality of automotive toys such as toy cars which are adapted to run on previously prepared running ways (tracks) in a limited location are driven, an intersection or intersections are normally used.

Automotive toys can enter the conventional intersection from any ways at any time. During passage of an automotive toy on an intersection, therefore, another automotive toy happens to enter the intersection, creating a problem that the latter would collide the former, resulting in breakage of the toys and/or interruption of the play with the automotive toys.

Further, the automotive toys of this kind travel only on the predetermined running ways. This makes the play monotonous and thus this makes the play less interesting.

SUMMARY OF THE INVENTION

The present invention was made under the above-mentioned circumstances and the object thereof is to prevent automotive toys from colliding with each other at an intersection portion and allow the ways on which the automotive toys run to be changed so as to make the play more interesting.

In order to achieve the object, an intersection apparatus for automotive toys according to the first aspect of the present invention comprises:

a first way on which an automotive toy runs;

a second way which intersects with the first way and on which an automotive toy runs;

an intersection portion at which the first and second ways intersect with each other; and an entrance control mechanism for stopping one automotive toy when the one automotive toy is approaching the intersection portion on one of the first and second ways while another automotive toy is passing the intersection portion.

When the another automotive toy on one of the first and second ways is passing the intersection portion, the intersection apparatus prevents the one automotive toy on the other way intersecting the one way from entering the intersection portion.

Accordingly, the automotive toys approaching the intersection portion on ways extending in different directions do not enter the intersection portion simultaneously. Thus, these automotive toys can be prevented from colliding with each other.

In the intersection apparatus, it is desired that the entrance control mechanism includes:

blocks each pushed by the another automotive toy which is entering the intersection portion thereby to open way which extends in a direction in which the another automotive toy is running; and stops each cooperating with movement of the blocks for stopping the one automotive toy which is approaching the intersection portion on one way which intersects with another way on which the another automotive toy is running, while the blocks are being pushed by the another automotive toy.

In the intersection apparatus, the block clears the way to the intersection portion by the push of an automotive toy which is going to enter the intersection portion, enabling the automotive toy to freely pass the intersection portion.

In cooperation with the movement of the block which movement opens the way, the stop ceases the running of the automotive toy approaching the intersection portion from the way intersecting the way on which the automotive toy which is passing the intersection is running.

Thus, while an automotive toy on a way is passing the intersection portion, the other automotive toy on the other way which is directed differently from the way on which the automotive toy passing the intersection portion is running can be prevented from entering the intersection portion.

In the intersection apparatus, it is also desired that the entrance control mechanism has a plurality of blocks rotatable around a center of the intersection portion and are arranged on the first and second ways in a normal condition, each of the blocks being arranged to be rotated by pressure of the one automotive toy which runs on one of the first and second ways so as to open the way extending in a direction in which the one automotive toy moves and interrupt other way.

It is further desirable in the intersection apparatus that it has an urging member for urging each of the blocks toward a standard position, and wherein each of the blocks has a front end portion with an inclining face which is pressed by the automotive toy to cause the blocks to be rotated when the automotive toy is passing the intersection portion.

In the intersection apparatus, each of the blocks may have a stop which stops the automotive toys and does not rotate the blocks even if the stops are pressed, and each blocks transfers the stop to the other way, upon rotation of the blocks.

In the intersection apparatus, the block whose inclining face is pressed by the automotive toy running on either the first way or the second way rotates from the standard position against the urging force of the urging member around the center of the intersection portion so as to open the way extending in the running direction of the automotive toy. While the automotive toy is passing the intersection portion, the block is pressed by the automotive toy and continues to open the way. In accordance with this rotation, the other block provided on the entrance control mechanism is rotated around the center of the intersection portion and move the stop to the other way.

As an automotive toy moves on the other way in this condition, a stop is pushed by the automotive toy. Since, however, the entrance control mechanism does not rotate, the automotive toy running on the other way stops.

When related block has come to be not pressed after an automotive toy has passed the intersection portion, the entrance control mechanism is rotated around the center of the intersection portion to the standard position by the urging force of the urging member.

In consequence, while one automotive toy is moving on the intersection portion, the other automotive toy on the ways other than the way on which the one automotive toy runs is prevented from entering the intersection portion.

In the intersection apparatus, each of the first and second ways may include s a first lane and a second lane;

each of the blocks has inclining faces, and a stop which stops the automotive toys and does not rotate the blocks even if the stop is pressed; and the inclining faces are formed on the corresponding first lane and second lane, and the blocks being rotated when one of the inclining faces is pressed by the automotive toy running on one of the first and second lanes to open the one of the first and second lanes and to place the stop on other of the first and second lanes.

In the intersection apparatus, the inclining faces of the blocks are placed on the first lane and the second lane of the corresponding ways.

An automotive toy runs on either the first lane or on the second lane and enters the intersection portion in this state. Then, the block is pushed by the automotive toy and is rotated to open one lane and places the stop on the other lane.

In consequence, while one automotive toy is moving on the intersection portion, the other automotive toy on the way other than the way on which the one automotive toy runs is prevented from entering the intersection portion.

In order to achieve the object of the present invention, the toy track according to the second aspect of the present invention comprises:

a first way on which an automotive toy runs;

a second way which intersects with the first way and on which another automotive toy runs;

a controller which stops one automotive toy which is approaching an intersection of the first and second ways on and moving one of the first and second ways, while another automotive toy is passing the intersection.

While one automotive toy is moving on the intersection portion in the intersection control system, the other automotive toy on the way other than the way on which the one automotive toy runs is prevented from entering the intersection portion.

Since, therefore, the automotive toys running on the ways extending in the different directions do not enter the intersection portion simultaneously, the automotive toys are prevented from colliding from side and/or behind.

In the toy track, it is preferred that the entrance control mechanism comprises:

opening means which is pushed by the another automotive toy entering the intersection and opens the way extending in a running direction of the another automotive toy; and stopper which stops the one automotive toy which is approaching the intersection.

The toy track may be provided such that the automotive toy entering the intersection portion pushes the opening means so that the opening means opens the way extending in the direction in which the automotive toy entering the intersection portion moves. Thus, the automotive toy can continue to run.

In cooperation of the actuation of the opening means for opening the way extending in the running direction of the automotive toy which pushes the opening means, the stopping means is actuated to stop the entrance of the automotive toy approaching the intersection portion on the other differently oriented way.

In this way, while the automotive toy which has pushed the opening means is passing the intersection portion, the automotive toy approaching the intersection portion on the other differently oriented way is prevented from entering the intersection portion.

The toy track may further including circulating way connecting the first way to the second way.

The toy track may comprise a branch way branched from the first way at a branch portion and a point provided between the first way and the branch way at the branch portion for leading an automotive toy which is running on the first way to the branch way or for causing the one of the automotive toys to continue to run on the first way beyond the branch portion.

The point may includes a point member which can project from and be retracted in the branch portion and which has a lateral wall connecting the branch way to the first way, the point member acting such that:

(1) when one automotive toy is running on the branch way, the lateral wall of the point member is pushed by the one automotive toy on the branch way whereby the point member pushes and leads the one automotive toy to the first way;

(2) when one automotive toy is running on the first way in a first direction, the lateral wall of the point member is pushed by the one automotive toy on the first way whereby the point member pushes and leads the one automotive toy to the branch way; and (3) when one automotive toy is running on the first way in a second direction, the point member is depressed in the branch portion by a pressure of the automotive toy on the first way to allow the one automotive toy to pass through the point member.

In this system, the point member extends into the branch portion when the automotive toy is not on the point.

When an automotive runs on the branch way and arrives at the branch portion, the lateral wall of the point member is pushed by the automotive toy. Thus, the point member leads the automotive toy to the first way.

When an automotive toy running on the first way in a first direction arrives at the branch way, the lateral wall of the point member is pushed by the automotive toy and the point member leads the automotive toy to the branch way.

When an automotive toy running on the first way in a second direction arrives at the branch portion, the point member is pushed by the automotive toy to be retracted in the branch portion, and the automotive toy passes the branch portion.

This arrangement makes it possible to change the running direction of the automotive toy after it has passed the point according to the entrance direction of the automotive toy toward the point.

In order to achieve the object of the present invention, the point apparatus according to the third aspect of the present invention comprises:

a way on which an automotive toy runs;

at least one branch portion formed on the way;

a branch way branched from the way at the branch portion;

a point for leading the automotive toy running on the branch way to the way or for allowing the automotive toy to continue to run on the way, according to a direction in which the automotive toy enters the branch portion.

In the point apparatus, the point may include a point member which can project from and be retracted in the branch portion and which has a lateral wall connecting the branch way to the way, the point member acting such that:

(1) when one of the automotive toys is running on the branch way, the lateral wall of the point member is pushed by the one automotive toy on the branch way whereby the point member pushes and leads the automotive toy to the way;

(2) when one of the automotive toys is running on the way in a first direction, the lateral wall of the point member is pushed by the one automotive toy on the way whereby the point member pushes and leads the one automotive toy to the branch way; and (3) when one of the automotive toys is running on the way in a second direction, the point member is retracted in the branch portion by a pressure of the one automotive toy on the way to allow the one automotive toy to pass through the point member.

In this point apparatus, the point member extends into the branch portion when an automotive toy is not on the point.

When an automotive toy running on the branch way arrives at the branch portion, the lateral wall of the point member is pushed by the automotive toy and it leads the automotive toy to the first way.

When an automotive toy running on the first way in a first direction arrives at the branch way, the lateral wall of the point member is pushed by the automotive toy and it leads the automotive toy to the branch way.

When an automotive toy running on the first way in a second direction arrives at the branch portion, the point member is pushed by the automotive toy to be retracted in the first way so that the automotive toy passes the branch portion.

This arrangement makes it possible to change the running direction of the automotive toy after it has passed the point according to the entrance direction of the automotive toy into the point.

In order to achieve the object of the present invention, a method of controlling automotive toys according to the fourth aspect of the present invention comprises the step of:

running an automotive toy on first toy track;

running an automotive toy on second toy track which intersect with the first toy track; and stopping one automotive toy when the one automotive toy is approaching an intersection of the first and second toy tracks, on one of the first and second toy tracks while another automotive toy is passing the intersection on another of first and second toy tracks.

In this method, it is preferred that each of the first and second tracks includes first and second lanes; and the stopping step stops the one automotive toy when one automotive toy is approaching the intersection on one of the first and second lanes while another automotive toy is passing the intersection on another of first and second leans.

According to this method, the automotive toys approaching the intersection portion on ways extending in different directions do not enter the intersection simultaneously. Thus, these automotive toys can be prevented from colliding with each other.

DETAILED DESCRIPTION OF THE PREFERRED EMBODIMENTS

The present invention will now be described in detail by way of the preferred embodiments set forth below with reference to the accompanying drawings.

First Embodiment

Figure 1:
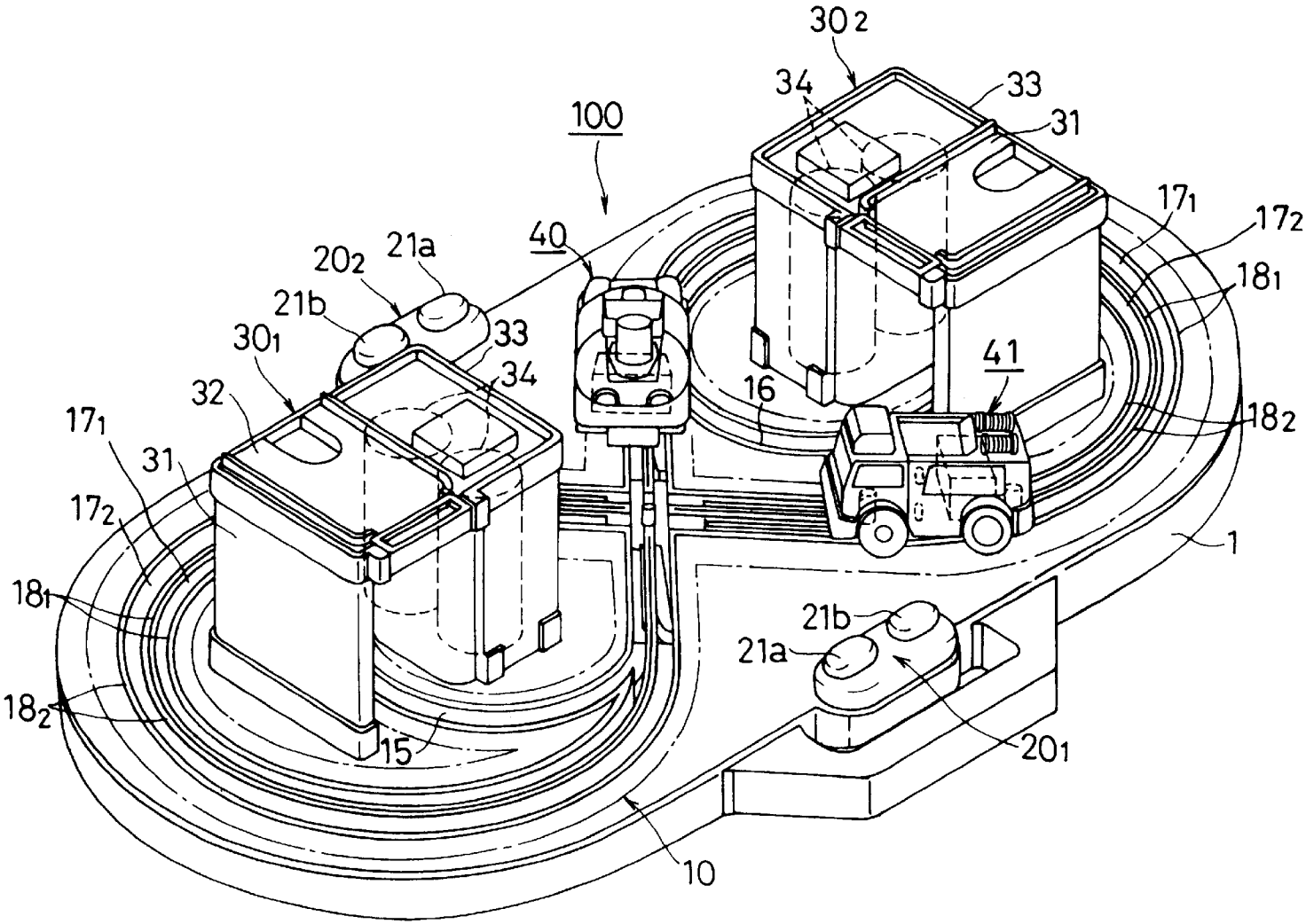
FIG. 1 is a perspective view of an intersection control system for automotive toys according to an embodiment of the present invention.

As shown in FIG. 1, an intersection control system 100 for automotive toys according to the first embodiment of the present invention comprises a generally elliptical synthetic resin base 1 having a running way portion (track) 10, operation portions $\mathbf{20}_1$ and $\mathbf{20}_2$ and waiting stations $\mathbf{30}_1$ and $\mathbf{30}_2$; and automotive toys (or toy cars) 40 and 41 running on the running way portion 10 in response to the operation of the operation portions $\mathbf{20}_1$ and $\mathbf{20}_2$.

The running way portion (track) 10 is intended to cause the automotive toys 40 and 41 to run thereon and comprises an 8-shaped circulating running way (track) and waiting ways 15 and 16 branched from the circulating running way.

Figure 2:
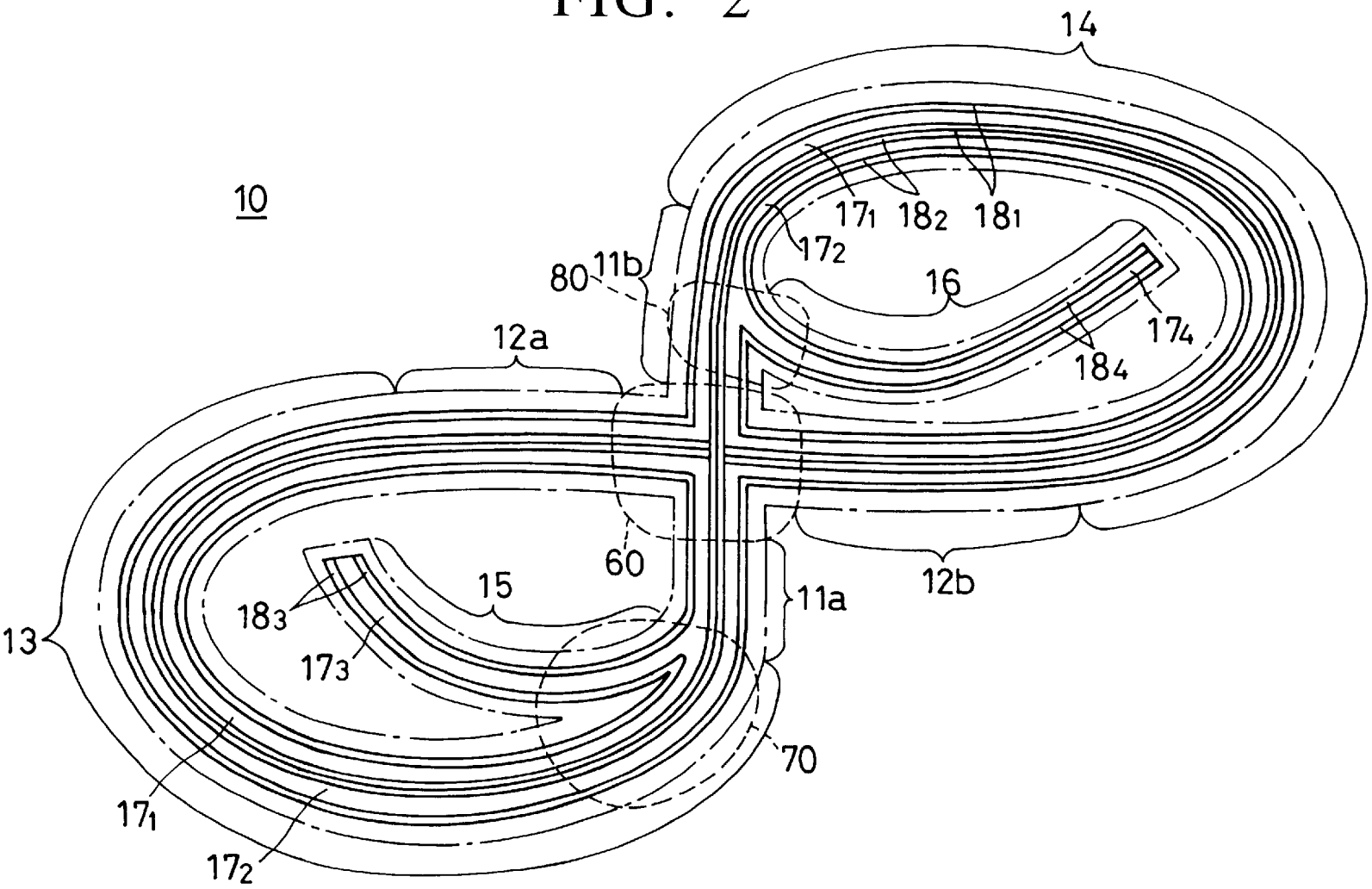
FIG. 2 is a perspective views of running ways of the intersection control system as shown in FIG. 1.

As shown in FIG. 2, the circulating running way comprises intersecting straight running ways 11*a*, 11*b*, 12*a* and 12*b*, an intersection portion 60 and arcuate running ways 13 and 14 for connecting the straight running ways 11*a* and 12*a* to the straight running ways 11*b* and 12*b*, respectively.

The waiting way 15 is branched from the arcuate running way 13. A point 70 is formed at the portion on which the waiting way 15 is branched from the arcuate running way 13. The waiting way 16 is branched from the straight running way 11*b*. A points 80 is formed at the portion on which the waiting way 16 is branched from the straight running way 11*b*.

Referring to FIGS. 1 and 2, the circulating running way has two guide lanes $\mathbf{17}_1$ and $\mathbf{17}_2$ arranged side by side on which the automotive toys 40 and 41 run. On the waiting way 15 is formed a guide lane $\mathbf{17}_3$ connected to the guide lane $\mathbf{17}_1$. On the waiting way 16 is formed a guide lane $\mathbf{17}_4$ connected to the guide lane $\mathbf{17}_2$.

Figure 3:
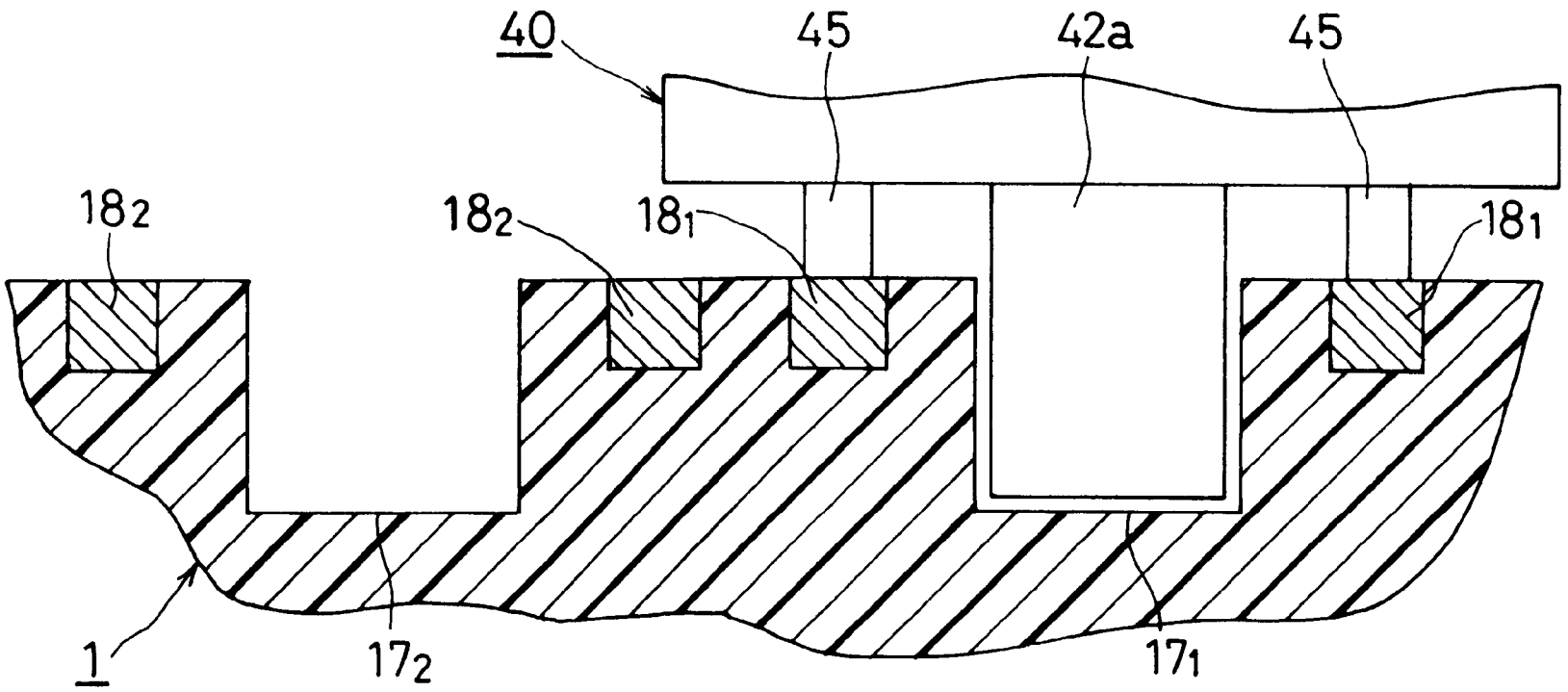
FIG. 3 is a transversal cross-sectional view of a running way as shown in FIG. 1.

As shown exemplarily in cross section in FIG. 3, the guide lanes $\mathbf{17}_1$ and $\mathbf{17}_2$ are formed to slidably engage guides 42*a* and 42*b* formed on the undersurfaces of the automotive toys 40 and 41. A pair of electric power supplying rails $\mathbf{18}_1$ and $\mathbf{18}_2$ for supplying electric power to the automotive toys 40 and 41 extend along the guide lanes $\mathbf{17}_1$ and $\mathbf{17}_2$ and can slidably contact the electric supply terminals 45 provided on the automotive toys 40 and 41.

Guide lanes $\mathbf{17}_3$ and $\mathbf{17}_4$ are formed similarly to the guide lanes $\mathbf{17}_1$ and $\mathbf{17}_2$ and are respectively provided with electric power supply rails $\mathbf{18}_3$ and $\mathbf{18}_4$ extending therealong so as to be slidable in contact with the electric supply terminals 45.

The automotive toys 40 and 41 may be toy police cars, toy fire engines, trains, vehicles or the like. The automotive toy 40 runs on and along the guide lane $\mathbf{17}_1$ according to the control of an operation portion $\mathbf{20}_1$, and the automotive toy 41 is driven on and along the guide lane $\mathbf{17}_2$ by the control of an operation portion $\mathbf{20}_2$.

Figure 4:
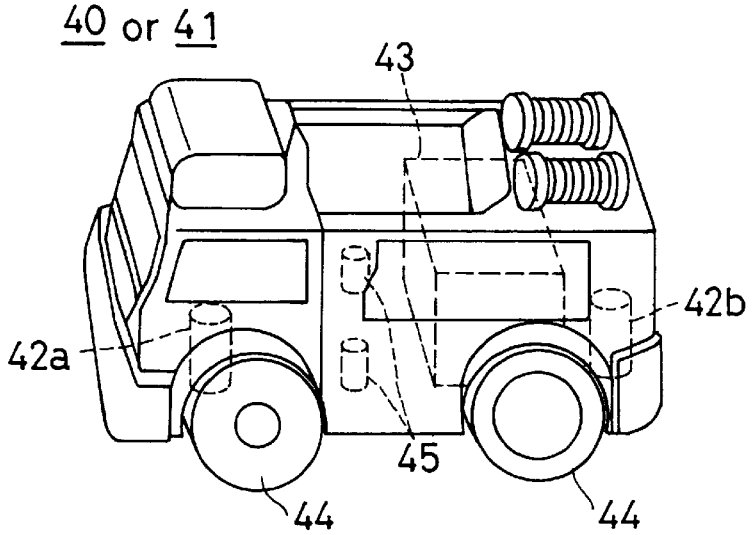
FIG. 4 is a perspective view of an embodiment of an automotive toy of the present invention, as shown in FIG. 1.

As shown in FIG. 4, the automotive toys 40 and 41 are provided with the guides 42*a*, 42*b*, motors 43, wheels 44 and the power supply terminals 45.

The guides 42*a* and 42*b* are formed on the front end portion and the rear end portion of the undersurface of each of the automotive toys 40 and 41, respectively, and slidably engage the guide lanes $\mathbf{17}_1$ and $\mathbf{17}_2$, respectively, to guide the automotive toys 40 and 41 on and along the guide lanes $\mathbf{17}_1$ to $\mathbf{17}_4$.

The distance between guides 42*a* and 42*b* is made larger the length of the intersection portion, i.e., the width of the running way.

As shown in FIG. 3, the power supply terminal 45 is provided on the undersurface of each of the automotive toys 40 and 41 so as to slidably engage the power supply rails $\mathbf{18}_1$ to $\mathbf{18}_4$. The terminal 45 supplies electric power to the motor 43 through these rails.

The motor 43 is mounted in each of the automotive toys 40 and 41 and is powered by the electric power supplied from the power supply terminal 45 to rotate the wheels 44, thereby running the automotive toys 40 and 41.

As shown in FIG. 1, waiting stations $\mathbf{30}_1$ and $\mathbf{30}_2$ are provided on the terminal ends of the waiting ways 15 and 16, respectively.

Figure 5:
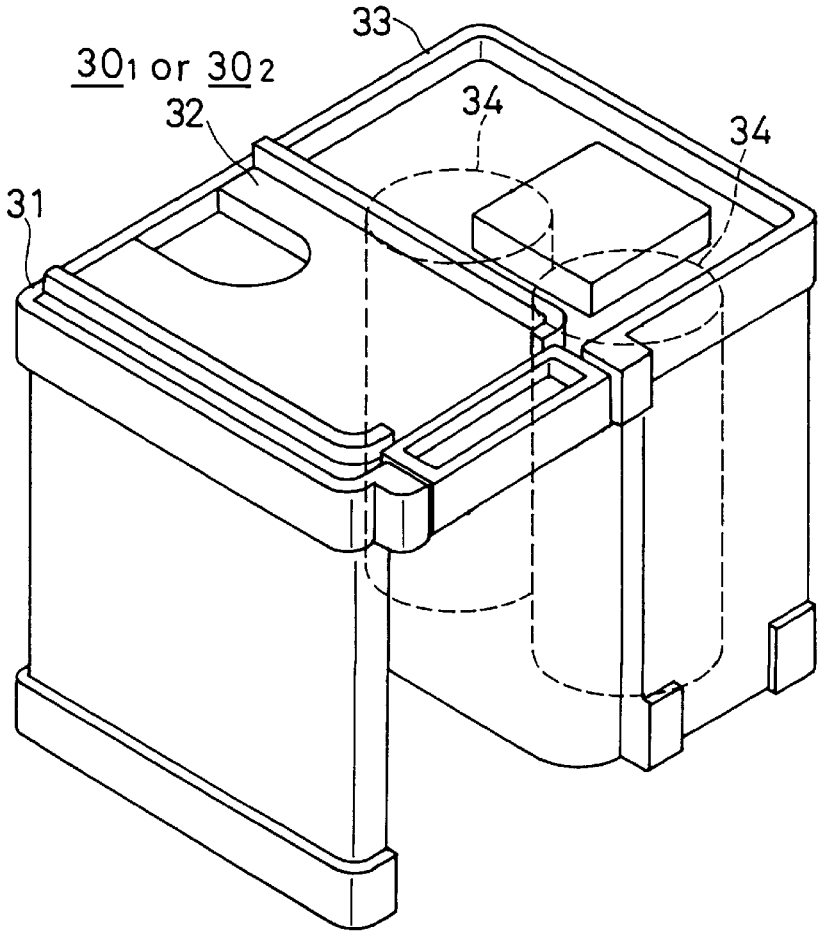
FIG. 5 is a perspective view of a waiting station of the system as shown in FIG. 1.

The waiting stations $\mathbf{30}_1$ and $\mathbf{30}_2$ have substantially the same structure. As shown in FIG. 5, each of them comprises a garage 31 for holding the waiting automotive toy 40 or 41 and an electric power source 33 for supplying electric power to the motor 43 through the electric power supply terminal 45.

The garages 31 are provided on the terminal ends of the waiting ways 15 and 16. A door 32 is provided on each of the garages 31 for opening and closing each garage 31.

Each electric power source 33 has an AC/DC converter, a cell box 34 for housing dry cells or the like. Electric power is supplied from the electric power source 33 to the automotive toys 40 and 41 through the electric power supplying rails $\mathbf{18}_1$ to $\mathbf{18}_4$.

As shown in FIG. 1, the operation portions $\mathbf{20}_1$ and $\mathbf{20}_2$ are arranged opposed to each other on both sides of the base 1. The operation portion $\mathbf{20}_1$ controls the operation (stopping, forward movement and rearward movement) of an automotive toy (40 in FIG. 1) running on the guide lane $\mathbf{17}_1$ or $\mathbf{17}_3$ and the operation portion $\mathbf{20}_2$ controls the operation of the other automotive toy (41 in FIG. 1) running on the guide lane $\mathbf{17}_2$ or $\mathbf{17}_4$.

Figure 6:
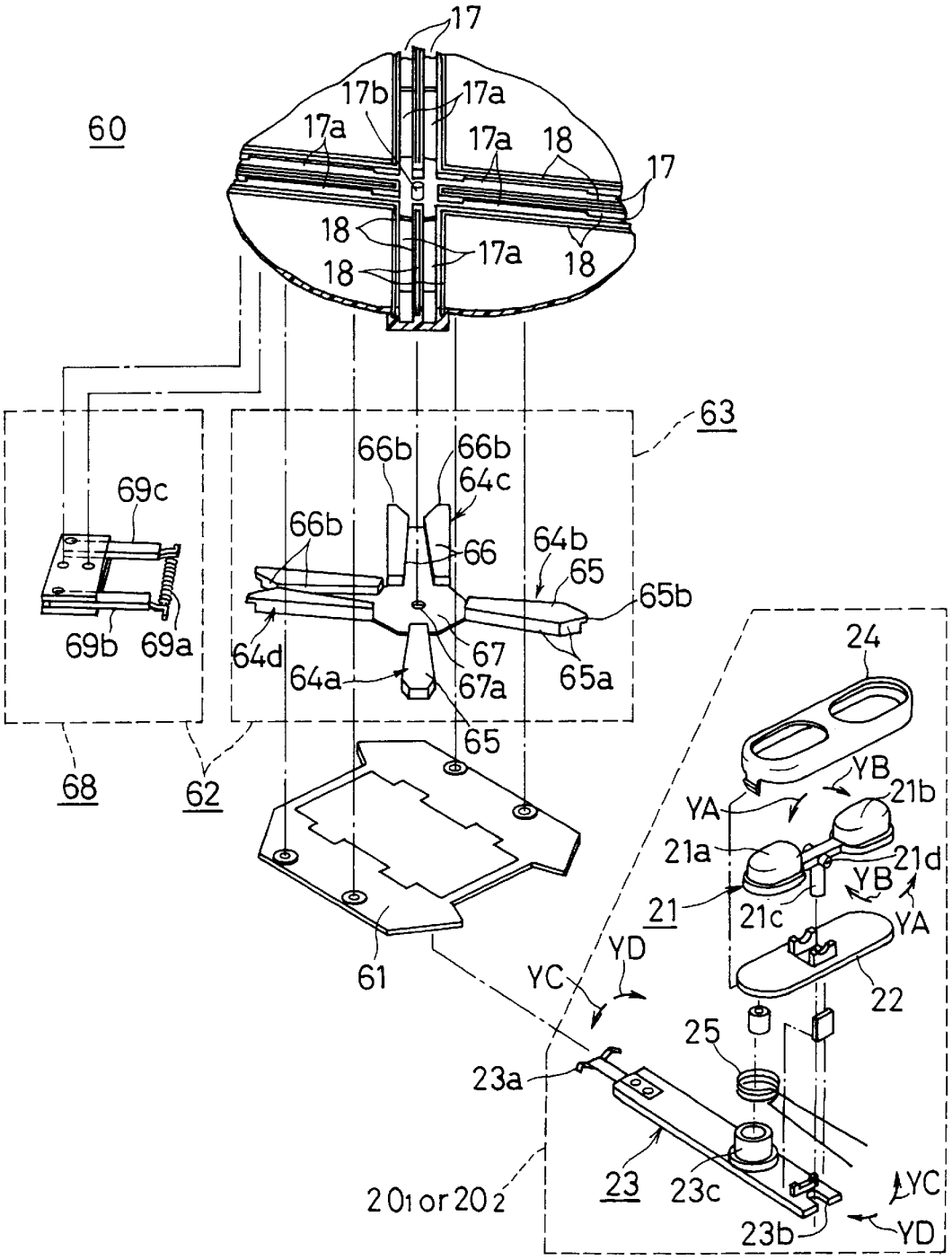
FIG. 6 is an exploded perspective view of an operation unit and an intersection control unit of the intersection control system as shown in FIG. 1.

As shown in an exploded perspective view in FIG. 6, each of the operation portions $\mathbf{20}_1$ and $\mathbf{20}_2$ comprises a switch 21 swingable around a shaft 21*d* in a YA direction or in a YB direction according to the intention of the operator (player), a supporting plate 22 for supporting the switch 21, an interconnecting lever 23, a cover 24 for covering the switch 21 and a coil spring 25 for maintaining the interconnecting lever 23 in a neutral position.

The switch 21 comprises an advancing knob 21*a*, a retarding knob 21*b*, an abutting rod 21*c* which abuts against a cut-away portion 23*b* formed in the interconnecting lever 23 and presses the same, and the shaft 21*d* rotatably supported by the supporting plate 22.

As the advancing knob 21*a* is pushed, the motor 43 of either automotive toy 40 or 41 is supplied with electric power and is rotated in the forward rotational direction so that either automotive toy 40 or 41 is moved forward. As the retarding knob 21*b* is pressed, on the other hand, either automotive toy 40 or 41 is supplied with electric power in reversal rotational direction, either automotive toy 40 or 41 is driven rearward.

The shaft 21*d* is rotatably supported by the supporting plate 22.

When the advancing knob 21*a* is pushed, the abutting portion 21*c* is rotated in the direction of the arrow YA and turns the interconnecting lever 23 in the direction of the arrow YC with the abutting portion 21*c* of the switch 21 engaging the cut-away portion 23*b* of the interconnecting lever 23. When, on the other hand, the retarding knob 21*b* is pushed, the interconnecting lever 23 is rotated in the direction of the arrow YB and swings the interconnecting lever 23 in the direction of the arrow YD with the abutting portion 21*c* of the switch 21 engaging the cut-away portion 23*b* of the interconnecting lever 23.

As shown in FIG. 6, the interconnecting lever 23 comprises a contact 23*a*, the cut-away portion 23*b* engaging the abutting portion 21*c*, a shaft 23*c* and a coil spring 25 for urging the interconnecting lever 23 to take a neutral position.

The electric power for forward movement or rearward movement is supplied to the motor 43 of either automotive toy 40 or 41 by changing over the connection of the contacts of the circuit pattern 61*a* (FIG. 7) formed on the undersurface of a circuit board 61 according to the swinging operation of the interconnecting lever 23 around the shaft 23*c* in the direction determined by the actuation of the switch 21.

The cut-away portion 23*b* is formed in an end of the interconnecting lever 23 and receives the abutting portion 21*c* in such a way that the interconnecting lever 23 is rotated around the shaft 23*c* in accordance with the swing of the switch 21.

A contact 23*a* is provided on the other end of the interconnecting lever 23 so that the contact 23*a* is slidable on the circuit pattern 61*a* formed on the undersurface of the circuit board 61 and changes over the polarity of the electric power supplied to electric power supplying rails $\mathbf{18}_1$ to $\mathbf{18}_4$.

As shown in FIG. 6, an intersection portion 60 comprises an intersection control apparatus 62 and the circuit board 61 for supplying electric power from the electric power source 33 to the electric power supplying rails $\mathbf{18}_1$ to $\mathbf{18}_4$ by changing over its polarity.

Figure 7:
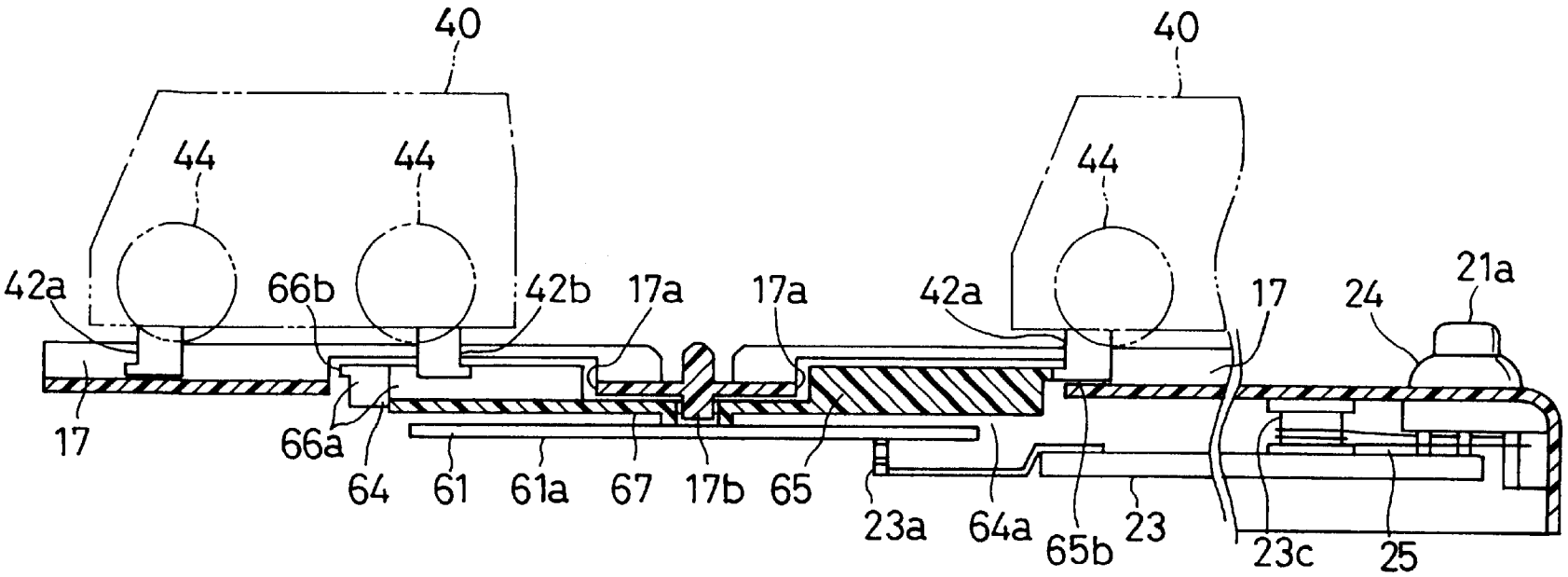
FIG. 7 is a transversal cross-sectional view of the operation unit and the intersection control apparatus of the intersection control system as shown in FIG. 1.

The circuit board 61 transmits the electric power from the electric power source 33 to the electric power supplying rail 18 and is provided with a rotation control unit 63. As shown in FIG. 7, the circuit pattern 61*a* connected to the electric power supplying rail 18 is formed on the circuit board 61.

When the interconnecting lever 23 is in the neutral position, the contact 23*a* is separated from the circuit pattern 61*a*. In this state, the electric power is not supplied to the electric power supplying rails 18. Thus, the automotive toys 40 and 41 stop. Upon pushing the knob 21*a*, the contact 23*a* is rotated in the direction of the arrow YC (FIG. 6) and short circuits the contacts on the circuit pattern 61*a* whereby the circuit board 61 supplies, to the electric power supplying rails 18, the electric power having the polarity in which the automotive toys 40 and 41 move forward. When, on the other hand, the knob 21*b* is pushed, the contact 23*a* is rotated in the direction of the arrow YD (FIG. 6) and short circuits the other contacts on the circuit pattern 61*a*, the circuit board 61 supplies, to the electric power rail 18, the electric power having the polarity in which the automotive toys 40 and 41 move rearward.

As shown in FIG. 6, the intersection control apparatus 62 has the rotation control unit 63 and an urging mechanism 68. When an automotive toy is passing the intersection portion 60, the intersection control apparatus 62 stops the other automotive toy which is approaching the intersection portion 60 in the other direction.

As shown in FIG. 6, the rotation control unit 63 comprises a rotary body 67 and arms 64*a* to 64*d* formed integral with the rotary body 67.

The rotary body 67 has a disc shape and has, at its central portion, a hole 67*a* rotatably fitted with a boss 17*b*. The arms 64*a* to 64*b* extend radially outward from the lateral sides so as to form a cross body.

Figure 11:
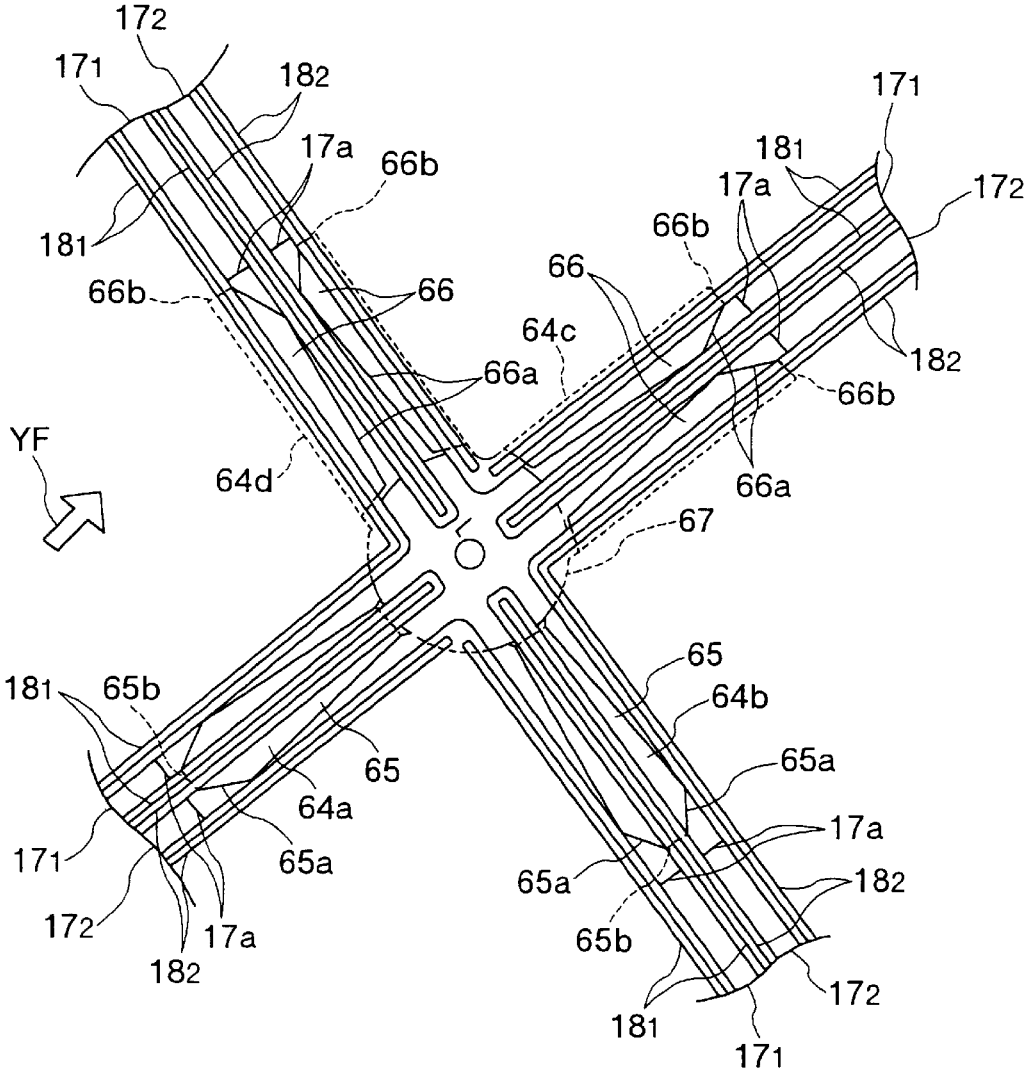
FIG. 11 is a plan view of an intersection portion of the intersection control system as shown in FIG. 1.

Each of the arms 64*a* and 64*b* is a substantial rhombus block 65 having thin distal and proximal ends and a central portion having a width substantially equal to the width of the circulating running way. An inclining side face 65*a* of the block 65 is pushed by the guides 42*a* and 42*b* of the automotive toys 40 and 41 in order to rotate the rotation control unit 63. In the normal state, the side faces 65*a* are arranged on the guide lanes $\mathbf{17}_1$ and $\mathbf{17}_2$ as shown in FIG. 11. The tip ends 65*b* of the blocks 65 function as stops for stopping the movement of the automotive toys 40 and 41. In the normal state, they are disposed between the guide lanes $\mathbf{17}_1$ and $\mathbf{17}_2$ as shown in FIG. 11.

Each of the arms 64*c* and 64*d* has a width substantially equal to the width of the circulating running way and provided with two opposed blocks 66. The block 66 has the same shape as that the shape of halves of the block 65 formed by longitudinally dividing the block 65. They are arranged on both sides of each of the arms 64*c* and 64*d*. A groove for allowing the guides 42*a* and 42*b* to pass therethrough is formed between the paired blocks 66. In the normal state, the blocks 66 are provided on the guide rails $\mathbf{17}_1$ and $\mathbf{17}_2$ as shown in FIG. 11. The tip ends 66*b* of the blocks 66 function as stops for stopping the movement of the automotive toys 40 and 41. The inner faces 66*a* of the blocks 66 are pressed against the guides 42*a* and 42*b* of the automotive toys 40 and 41 for rotating the rotation control unit 63.

The arms 64*a* to 64*d* are made larger than the distance between the guides 42*a* and 42*b* of each of the automotive toys 40 and 41.

The urging mechanism 68 maintains the rotation control unit 63 in a home position, i.e., in a normal position as shown in FIG. 11.

The urging mechanism 68 comprises, for example as shown in FIG. 6, swing levers 69*b* and 69*c* and a coil spring 69*a* for urging the swing levers 69*b* and 69*c*. The swing levers 69*b* and 69*c* hold the arm 64*d* between their lateral faces and urge the rotation control unit 63 to take a home position.

Each of guide lanes $\mathbf{17}_1$ and $\mathbf{17}_2$ of the intersection portion 60 has a plurality of openings (cut-away portions) 17*a* and a boss 17*b*.

As shown in FIGS. 6 and 7, the boss 17*b* extends upward and downward from the bottom wall of a guide lane 17 in the central portion of the intersection portion 60 and rotatably supports the rotation control unit 63.

The openings 17*a* are formed in the straight running ways 11*a*, 11*b*, 12*a* and 12*b* and allow the blocks 65 and 66 of the arms 64*a* to 64*d* to rotate around the boss 17*b* and to extend into the guide lanes $\mathbf{17}_1$ and $\mathbf{17}_2$.

Figure 8:
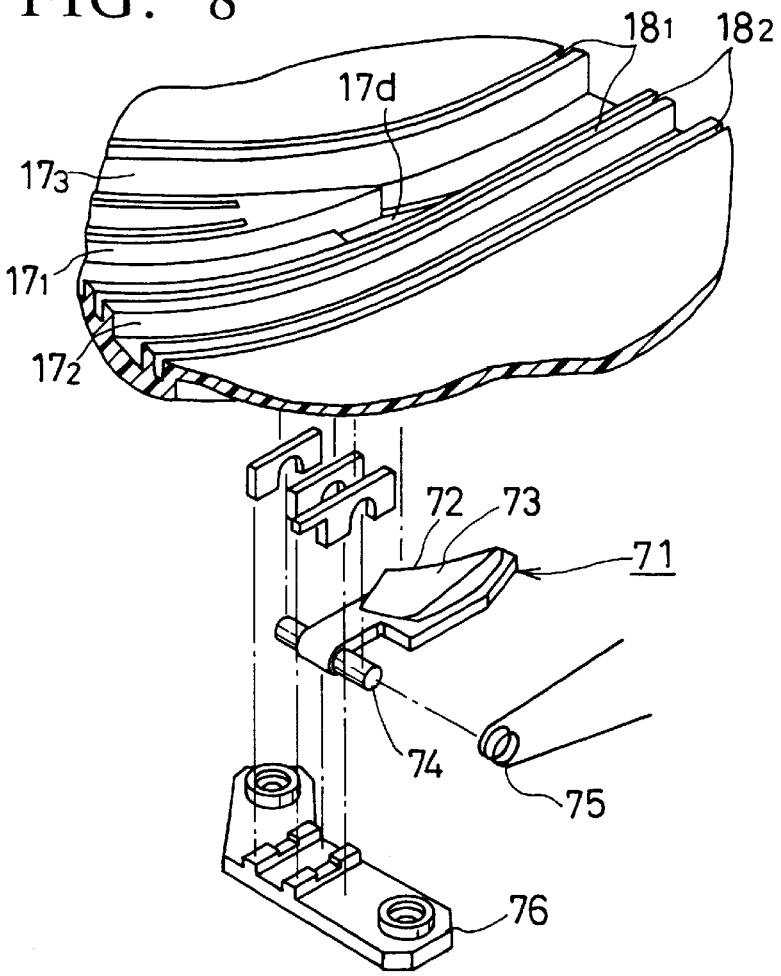
FIG. 8 is an exploded perspective view of a point (a change-over mechanism for changing over the running directions of automotive toys) of the intersection control system as shown in FIG. 1.
Figure 9:
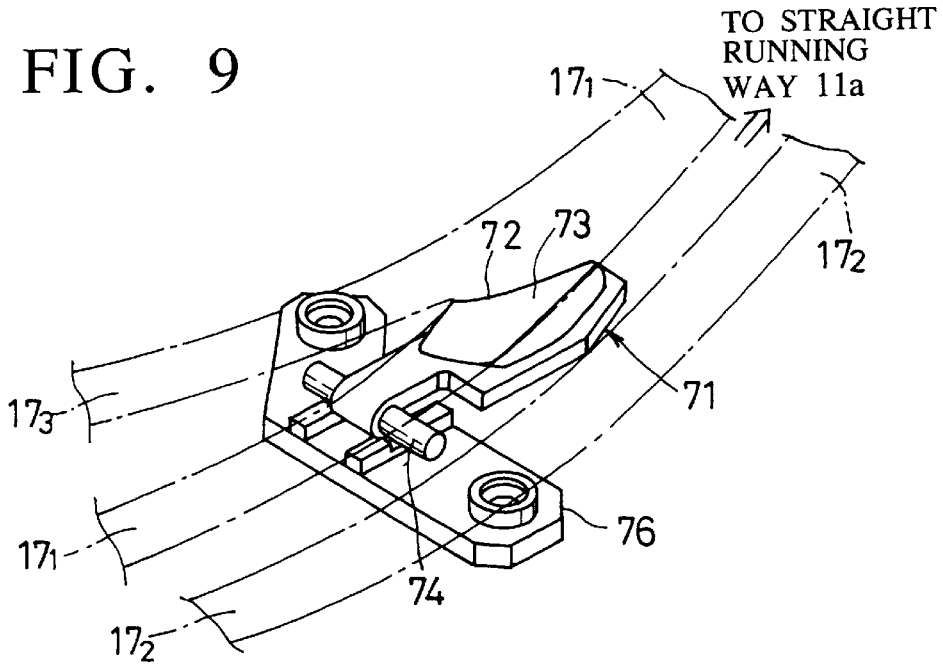
FIG. 9 is a perspective view of the point as shown in FIG. 8.

FIGS. 8 and 9 show an exploded perspective view and a perspective view of a point 70, respectively.

As shown in FIG. 2, the point (the running way change-over portion) 70 is a portion at which the arcuate running way 13 and the waiting way 15 can be branched from the running way 11*b* so that the running directions of the automotive toys 40 and 41 can be changed over to the required directions there.

As shown in FIG. 8, the point 70 comprises a point member 71, a spiral spring 75 for causing the point member 71 to project from a later-described opening 17*d* and a base member 76 for fixing the point member 71 to the base. In the portion at which the guide lane $\mathbf{17}_1$ of the arcuate running way 13 and the guide lane $\mathbf{17}_3$ of the waiting way 15 merge is formed an opening 17*d* which has a shape for allowing the point member 71 to project from and to be retracted into the opening 17*d*.

Referring to FIG. 8, the point member 71 has a vertical wall 72, an inclining face 73 and a hinge 74.

As shown in FIG. 9, the vertical wall 72 smoothly connects the portion, at which one of the side walls of the guide lane $\mathbf{17}_1$ formed in the arcuate running way 13 and a side wall of the guide lane $\mathbf{17}_3$ formed in the waiting way 15 merge, to other wall of the guide lane $\mathbf{17}_1$, in a state in which the vertical wall 72 projects from the opening 17*d*. Since the vertical wall has this structure, the vertical wall 72 leads the guides 42*a* and 42*b* to the waiting way 15 when the guides 42*a* and 42 run on the guide lane $\mathbf{17}_1$ of the straight running way 11*a* and abut against the vertical wall 72. In contrast, when the guides 42*a* and 42*b* run on the guide lane $\mathbf{17}_3$ of the waiting way 15 and abut against the vertical wall 72, the vertical wall 72 leads them to the guide lane $\mathbf{17}_1$ of the straight running way 11*a*.

As shown in FIG. 9, the inclining face 73 is formed so as to gradually descend from the tip end of the point member 71 toward its root (the vicinity of the hinge 74) in such a way that the point member 71 is retracted into the opening 17*d* when the inclining face 73 is pushed by the guides 42*a* and 42*b* moving on the guide lane $\mathbf{17}_1$ of the arcuate running way 13.

The hinge 74 supports the point member 71 at an end thereof so that the point member 71 projects from and is retracted into the opening 17*d*.

The base member 76 is fixed to the base 1 and supports the hinge 74. The spiral spring 75 urges the point member 71 upward so as to allow the point member 71 to project from the opening 71*d*.

A point 80 is formed at the portion at which the waiting way 16 is branched from the straight running way 11*b*. The point 80 has the similar structure to that of the point 70 and changes over the moving direction of the guides 42*a* and 42*b* between the guide lane $\mathbf{17}_2$ of the circulating running way and the guide lane $\mathbf{17}_4$ of the waiting way 16.

There will now be described how to use an automatic toy driving system 100 which has the above-mentioned structure.

For simplicity of the explanation, it is assumed that the automotive toy 40 is in the garage 31 in the waiting station $\mathbf{30}_1$ and the door 32 of the garage 31 is opened.

In the normal state, the switch 21 of the operation portion $\mathbf{20}_1$ is maintained in a neutral position under the urging force of the coil spring 25, and the contact 23*a* formed on the interconnecting lever 23 is separated from the circuit pattern 61*a* formed on the circuit board 61. Thus, electric power is not supplied to the electric power supplying rails $\mathbf{18}_1$ and $\mathbf{18}_3$, and the automotive toy 40 stops.

When the knob 21*a* of the switch 21 is depressed in this state, the switch 21 is rotated in the direction of the arrow YA (FIG. 6), and the abutting portion 21*c* pushes the cut-away portion 23*b* in the direction of the arrow YC (FIG. 6). The interconnecting lever 23 is rotated in the direction of the arrow YC (FIG. 6) and the contact 23*a* contacts the circuit pattern 61*a*, whereby the voltage having the polarity showing the forward movement of the automotive toy 40 is applied to the electric power supplying rails $\mathbf{18}_1$ and $\mathbf{18}_3$ from the electric power source 33.

The voltage applied to the electric power supplying rails $\mathbf{18}_1$ and $\mathbf{18}_3$ is also applied to the motor 43 housed in the automotive toy 40 through the electric power supplying terminal 45. The motor 43 is rotated in the forward direction to revolve the wheels 44 in the forward direction. The automotive toy 40 begins to move toward the point 70 of the waiting way 15.

Figure 10:
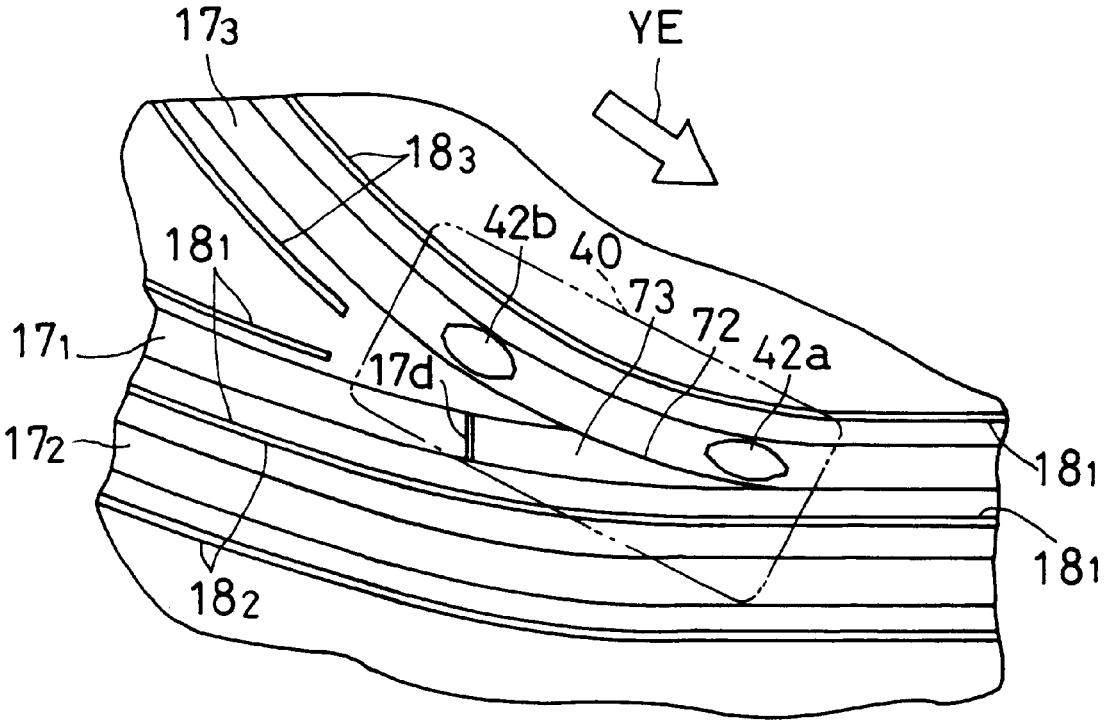
FIG. 10 is a plan view showing the state in which an automotive toy is now entering an intersection portion of the intersection control system as shown in FIG. 1.

As shown in FIG. 10, the automotive toy 40 moves from the waiting way 15 in the direction of the arrow YE and enters the point 70. The guide 42*a* of the automotive toy 40 abuts against the vertical wall 72 of the point member 71. In this state, the point member 71 continues to project under the urging force of the spiral spring 75.

As shown in FIG. 10, therefore, the guide 42*a* moves along the vertical wall 72 and is moved to the straight running way 11*a*. As the guide 42*a* moves, the automotive toy 40 further moves on the straight running way 11*a* and arrives at the intersection portion 60.

When the automotive toy 40 and 41 are not on the intersection portion 60, the stop 65*b* provided on each of the arms 64*a* and 64*b* is retracted in between the two parallel guide lanes $\mathbf{17}_1$ and $\mathbf{17}_2$ and the block 65 extends from the cut-away portion 17*a* in the space between the two guide rails $\mathbf{17}_1$ and $\mathbf{17}_2$.

The stops 66*b* of the arms 64*c* and 64*d* are at the outside of the two parallel guide lanes $\mathbf{17}_1$ and $\mathbf{17}_2$ and the blocks 66 extend from the cut-away portion 17*a* into the two guide lanes $\mathbf{17}_1$ and $\mathbf{17}_2$.

In this state, the automotive toys 40 and 41 can enter the intersection portion 60 from any running ways.

Figure 12:
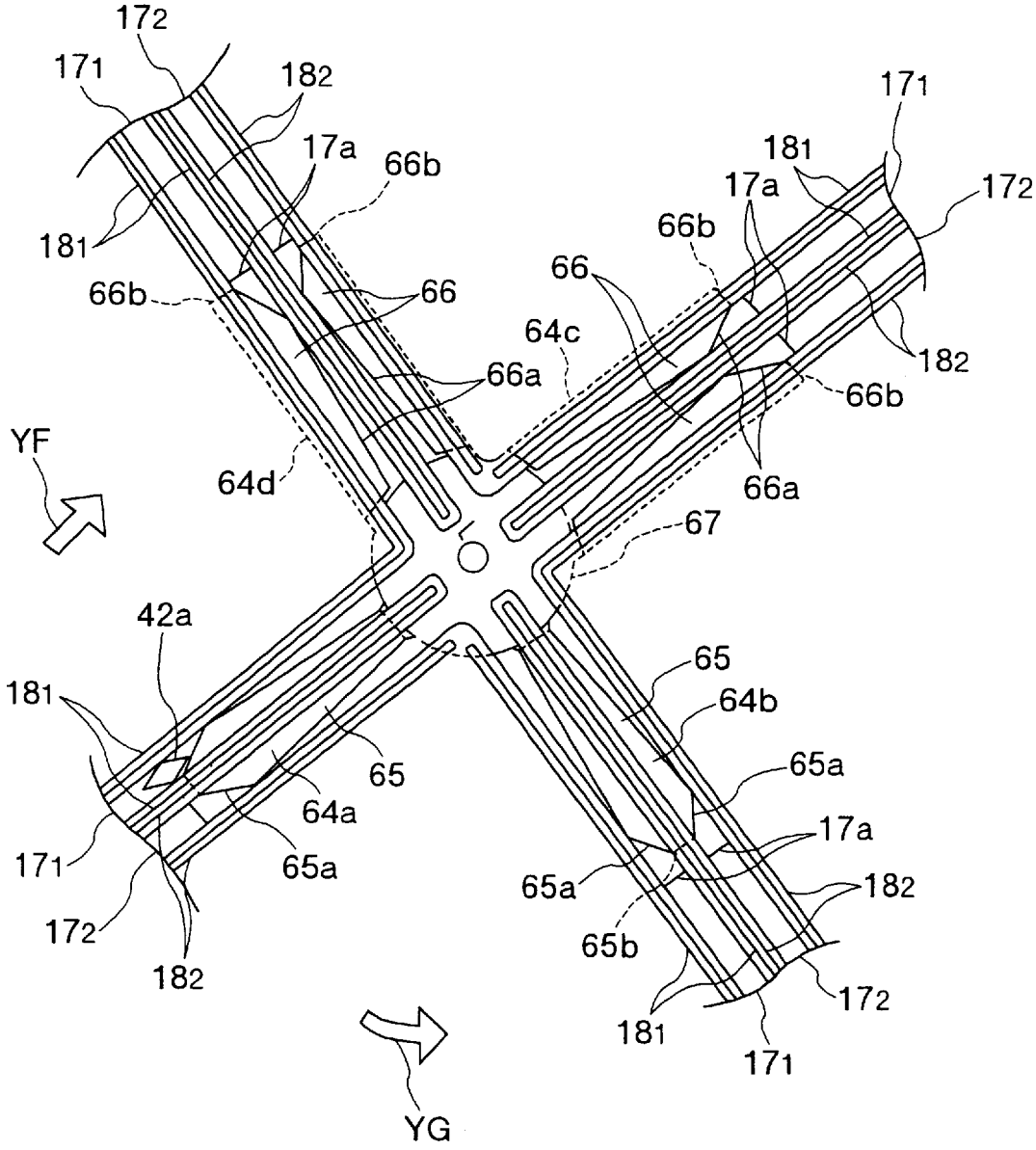
FIGS. 12 to 16 are plan views illustrating the operation of the intersection control system of FIG. 1, in which an automotive toy starts to approach the intersection portion, then arrives thereat and finally passes therethrough.

As the automotive toy 40 moves in the direction of the arrow YF and enters the intersection portion 60 as shown in FIG. 12, the guide 42*a* abuts against the inclining portion 65*a* of the tip portion of the block 65 which extends from the opening 17*a* in the guide lane $\mathbf{17}_1$, and the guide 42*a* presses the block 65. Due to this pressing process, the rotation control unit 63 is rotated in the direction of the arrow YG (FIG. 12).

Figure 13:
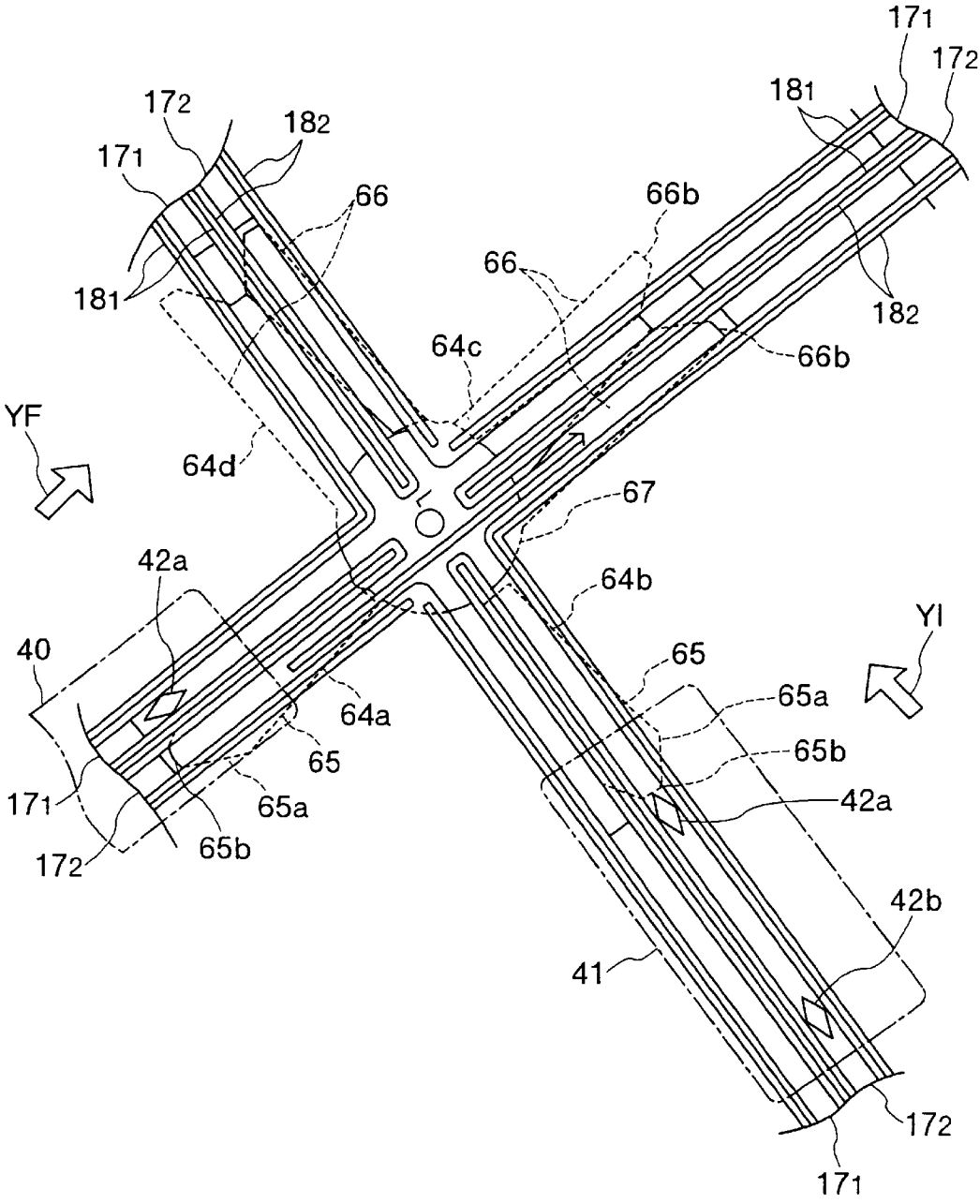

Upon rotation of the rotation control unit 63 in the direction of the arrow YG, as shown in FIG. 13, the blocks 65 of the arms 64*a* and 64*b* are retracted from the guide lane $\mathbf{17}_1$ which is a running way of the automotive toy 40, and the stop 65*b* is placed on the other guide lane $\mathbf{17}_2$.

The blocks 66 of the arms 64*c* and 64*d* are retracted from the guide lane $\mathbf{17}_1$ which is one of the running ways of the automotive toy 40, and a groove between the blocks 66 is disposed on the guide lane $\mathbf{17}_1$. The stop 66*b* of the block 66 is disposed on the other guide lane $\mathbf{17}_2$.

Since the blocks 65 and 66 are retracted from the guide lane $\mathbf{17}_1$ on which the automotive toy 40 is running, the automotive toy 40 can continue to run.

The automotive toy 40 continues to run with the block 65*a* kept pressed by the guide 42*a*.

Figure 14:
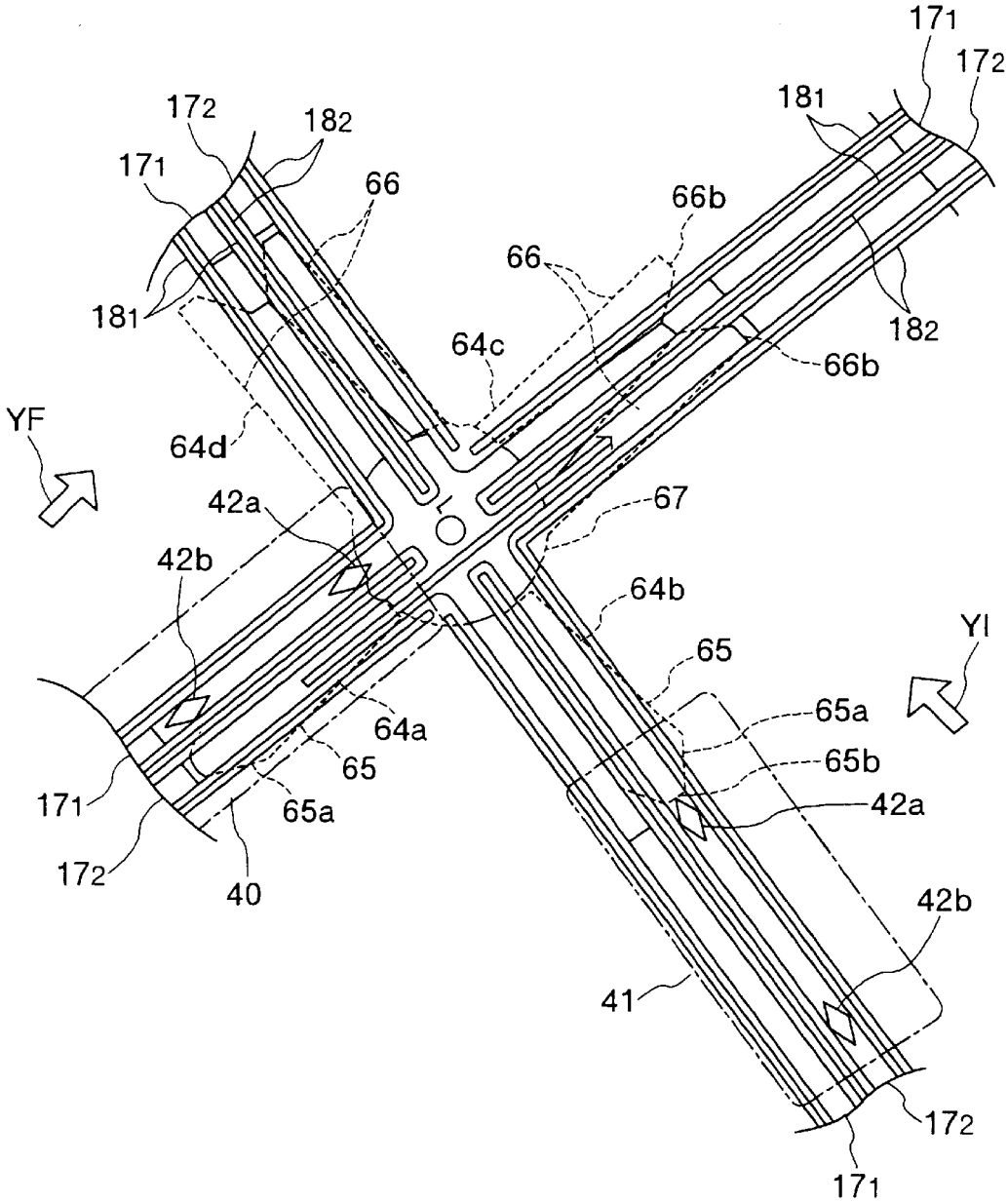
Figure 15:
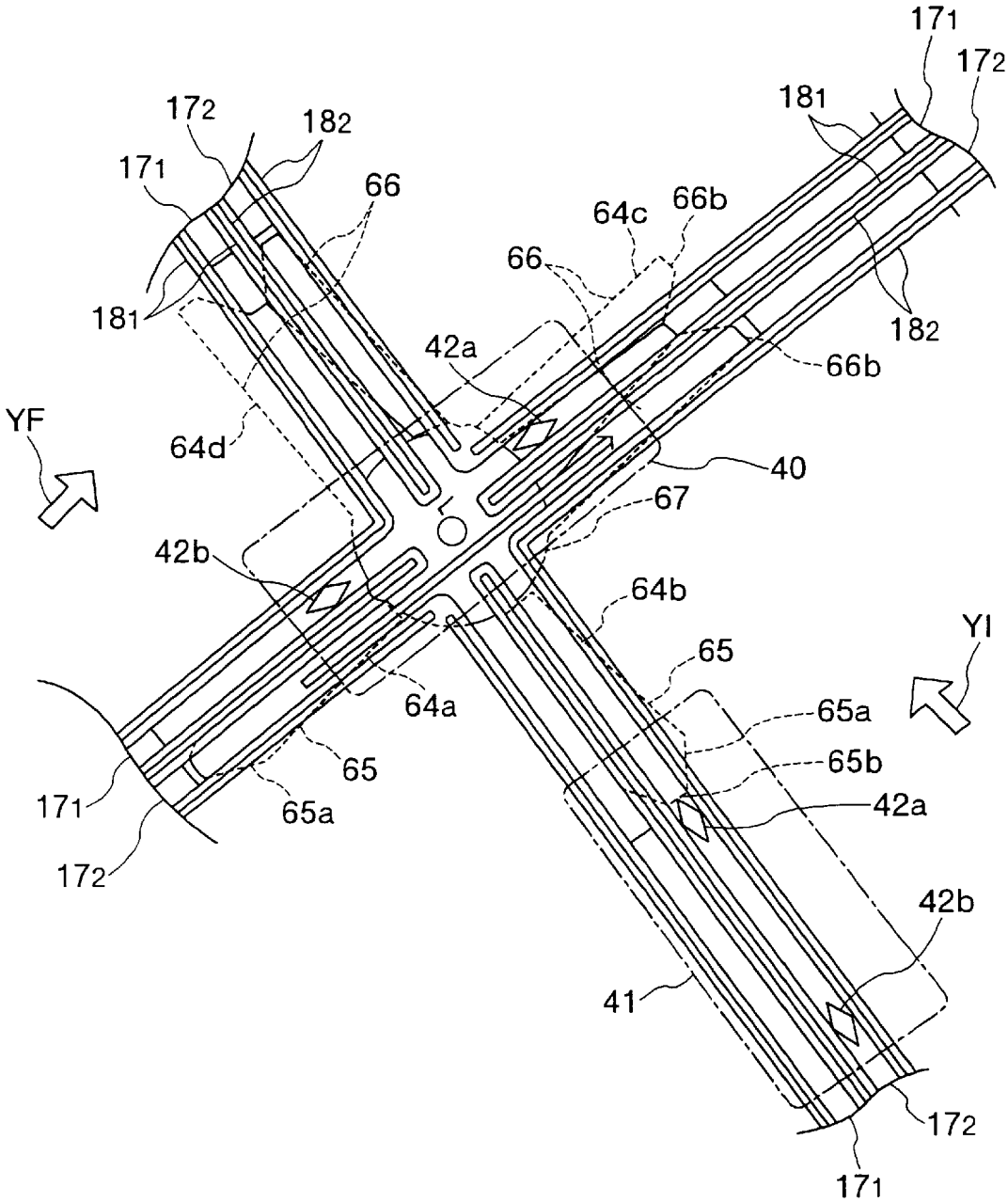

As the automotive toy 40 approaches the central portion of the intersection portion 60 and the guide 42*a* arrives at the vicinity of the terminal end (the root) of the block 65, the rear guide 42*b* abuts against the block 65, and the block 65 is maintained in a state in which the block 65 is retracted from the guide lane $\mathbf{17}_1$ as shown in FIG. 14.

When the automotive toy 40 arrives at the central portion of the intersection portion 60, the guide 42*b* is disengaged from the block 65 and is inserted in a groove formed between the blocks 66 of the arm 64*c*. In this condition, the guide 42*b* is moved in a state in which the guide 42*b* abuts against the block 66.

Figure 16:
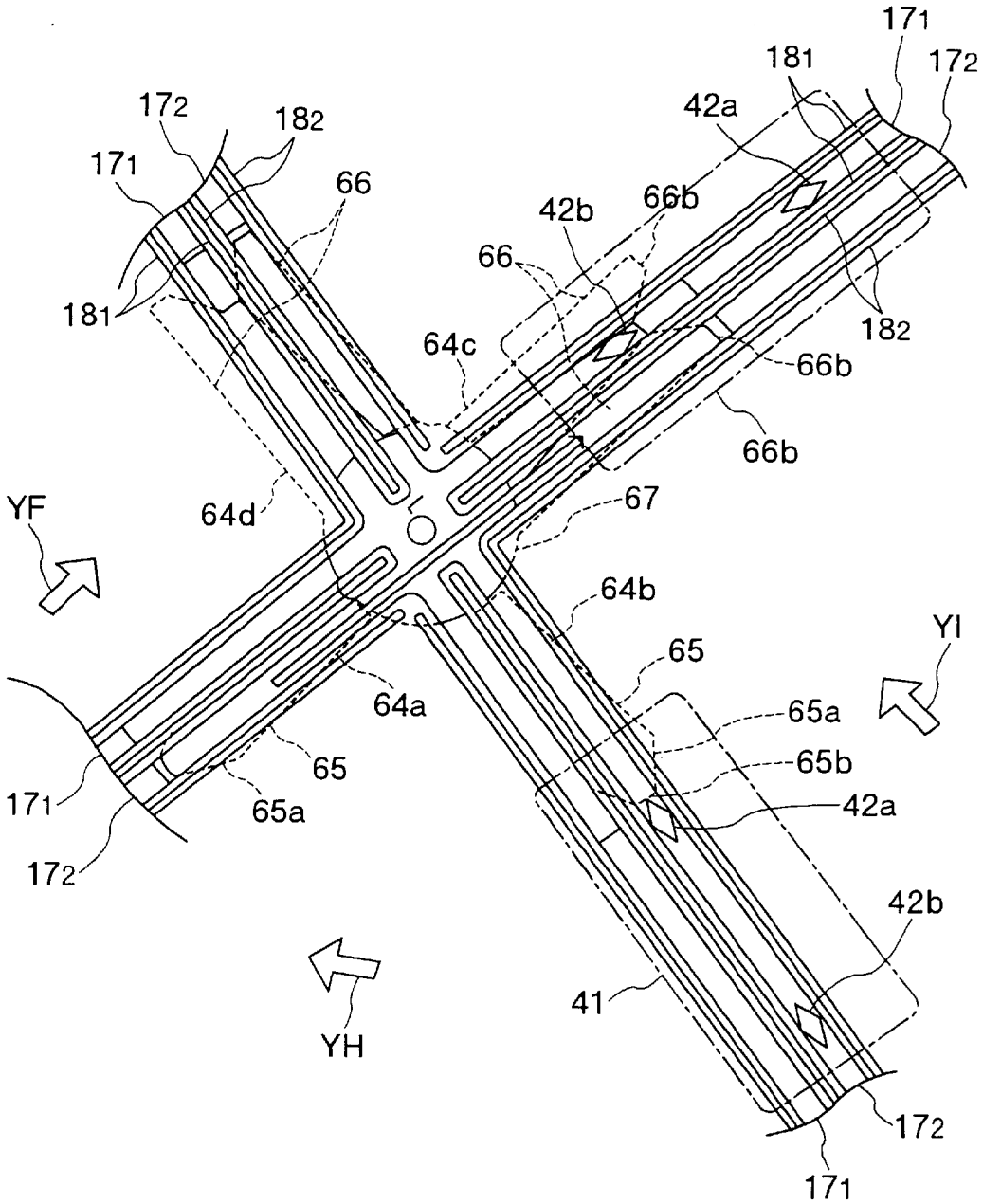

When the automotive toy 40 continues to run, the guide 42*b* is disengaged from the block 66, and the block 66*a* is pressed only by the guide 42*b*, as shown in FIG. 16.

As the automotive toy 40 moves further, the guide 42*b* is disengaged from the block 66. The rotation control unit 63 is turned in the direction of the arrow YH (FIG. 16) by the urging force of the spiral spring 69*a* and is moved to the home position.

Referring to FIGS. 13 to 16, as the other automotive toy 41 is running on the guide lane $\mathbf{17}_2$ in the direction of the arrow YI toward the intersection portion 60 while the automotive toy 40 is passing the intersection portion 60, the guide 42*a* provided on the automotive toy 41 abuts against the stop 65*b* of the arm 64*b*, thereby stopping the automotive toy 41.

The automotive toy 40 passes the intersection portion 60 and the rotation control unit 63 is moved to the neutral position. Then, the stop 65*b* is retracted from the guide lane $\mathbf{17}_2$ and the automotive toy 41 pushes the block 65. Thus, the block 65 is retracted from the guide lane $\mathbf{17}_2$ to enable the automotive toy 41 to run.

As an automotive toy 40 passes a guide lane $\mathbf{17}_1$ on which an automotive toy 40 is running and enters the intersection portion 60, the intersection control apparatus 62 opens the running way in the running direction of the automotive toy 40. While the automotive toy 40 is running on the intersection portion 60, the other automotive toy 41 which is running in the other direction on the other guide lane and is approaching the intersection portion 60 is stopped. Thus, both automotive toys 40 and 41 are prevented from entering the intersection portion 60 at the same time.

Figure 17A:
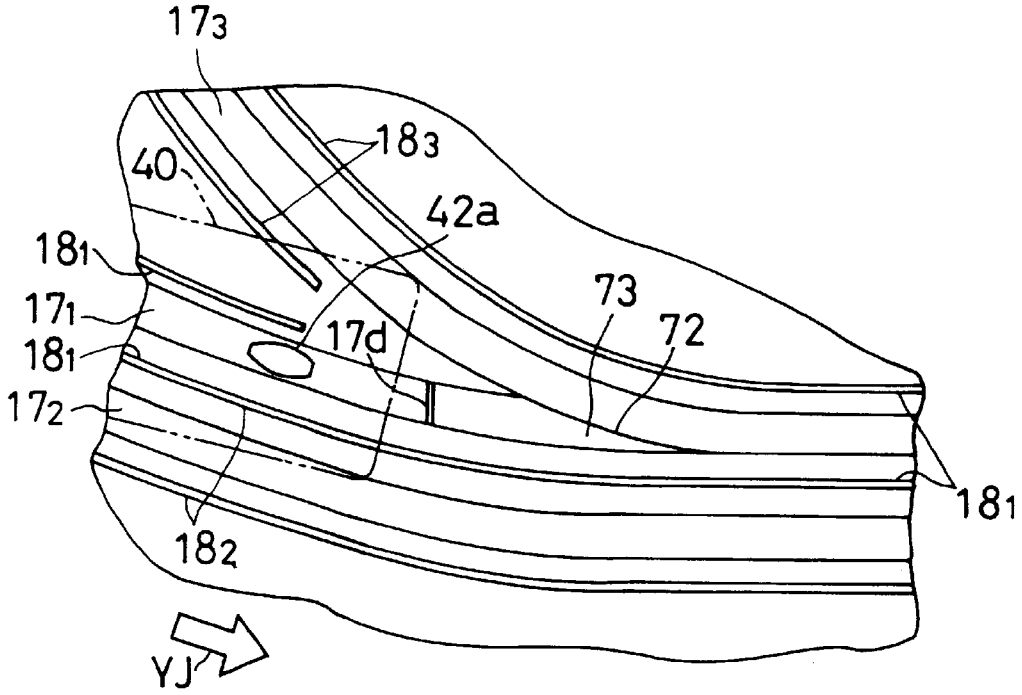
FIGS. 17A to 18B show the operation of the point of the intersection control system as shown in FIG. 1, when the automotive toy is moving forward.
Figure 17B:
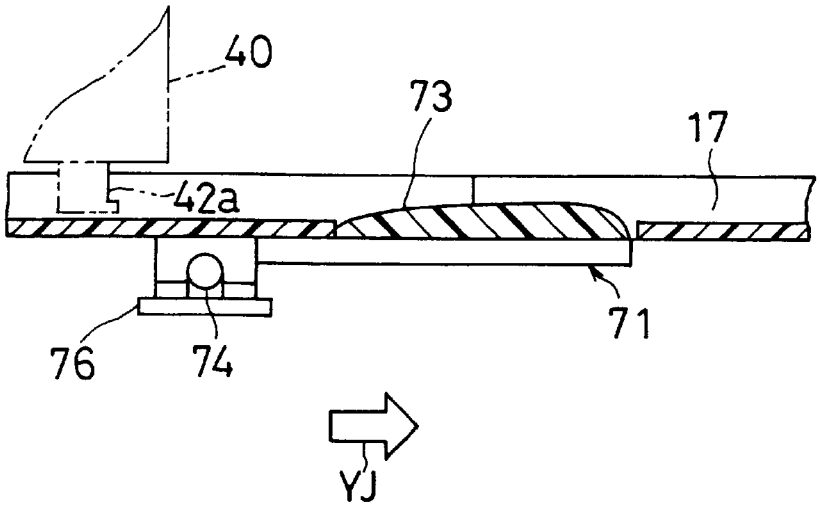

The automotive toy 40 which has passed the intersection portion 60 runs on the circulating running way in the direction of the arrow YJ and enters the point 70, as shown in a plan view in FIG. 17A and in a cross-sectional view in FIG. 17B.

Figure 18A:
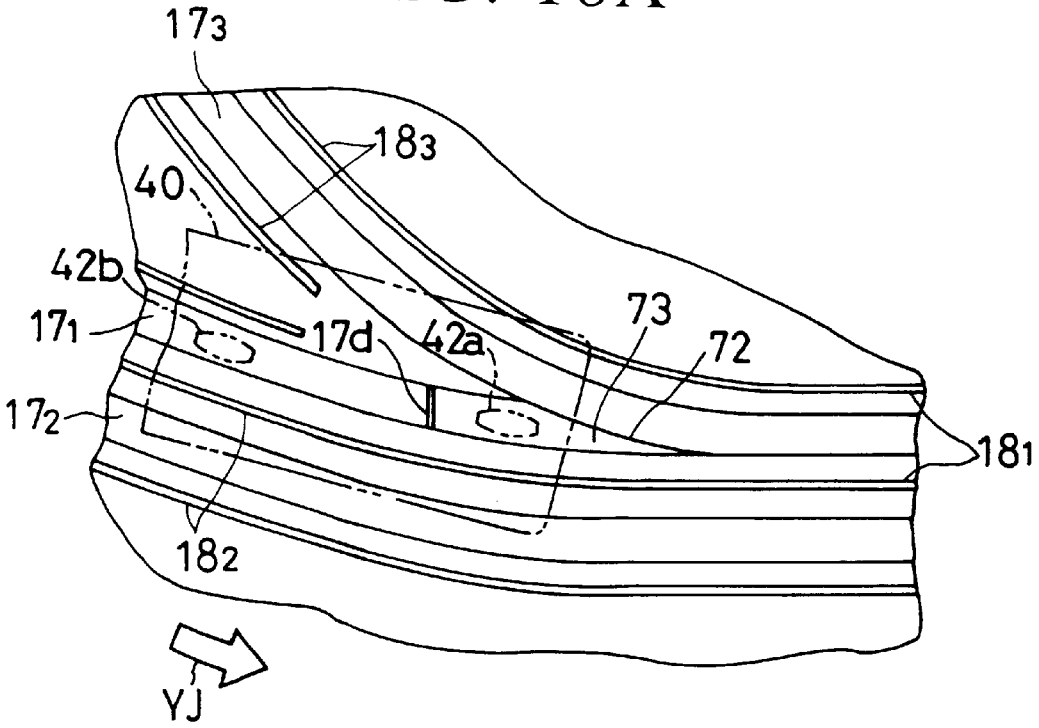
Figure 18B:
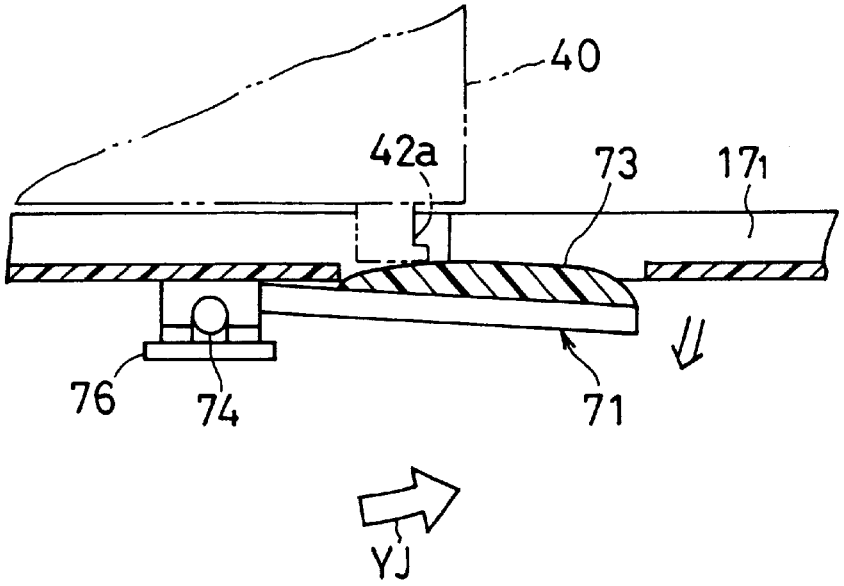

The guide 42*a* of the automotive toy 41 which is driven in the direction of the arrow YJ and approaches the intersection portion 70 pushes the inclining face 73 of the point member 71 downward and in the direction of the forward movement, as shown in FIGS. 18A and 18B.

By this pushing operation, the point member 71 is retracted in the opening 17*d* against the urging force of the spiral spring 75, as shown in FIG. 18B. The point member 71 is also retracted in the opening 17*d* by pressing the guide 42*b*.

The retraction of the point member 71 in the opening 17*d* allows the guides 42*a* and 42*b* to be moved in the direction of the arrow YJ. The automotive toy 40 continues to run in the direction of the arrow YJ together with the guides 42*a* and 42*b*, passes the point 70 and then further moves toward the straight running way 11*a*.

In this way, the point member 71 is retracted in the guide lane $\mathbf{17}_1$ by abutting the inclining surface 73 against the guides 42*a* and 42*b*. This enables the automotive toy 40 to continue to run.

When the knob 21*b* of the operation portion $\mathbf{20}_1$ is depressed in this state, the interconnecting lever 23 is rotated in the direction of the arrow YD as shown in FIG. 6, and the connection of the contacts of the circuit board 61*a* is changed over. Voltage having the polarity in which the automotive toy 40 is moved reverse is applied to the electric power supplying rails $\mathbf{18}_1$.

Figure 19:
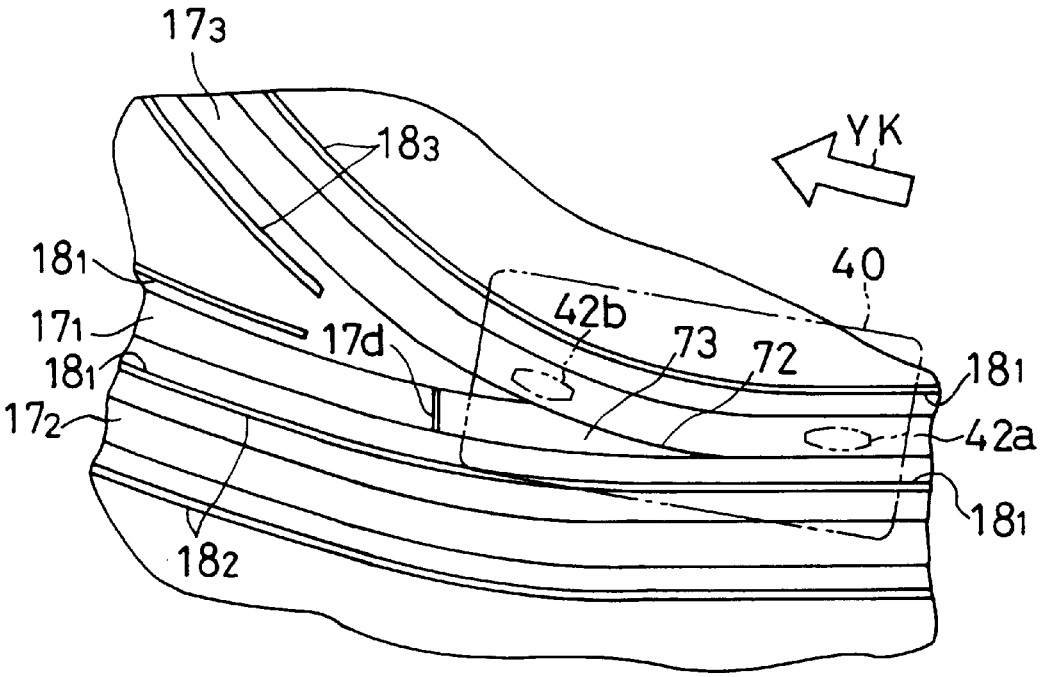
FIG. 19 shows the operation of the point of the intersection control system as shown in FIG. 1 when the automotive toy is moving rearward.

As a result, the automotive toy 40 commences the rearward movement in the direction of the arrow YK and enters the point 70 as shown in FIG. 19. The guide 42*b* provided on the automotive toy 40 abuts against the vertical wall 72 of the point member 71 and presses the same. Since, however, the point member 71 is retained in a projecting state, the guide 42*b* moves along the vertical wall 72 as shown in FIG. 19 and is lead to the guide lane $\mathbf{17}_3$ of the waiting way 15. Thus, the automotive toy 40 passes the waiting way 15 and arrives at the garage 31.

Upon releasing the switch 21, the interconnecting lever 23 is swung to the neutral position and the contact of the circuit pattern 61*a* is separated from the contact 23*a*. The supply of the electric power to the electric power supplying rails 18 is terminated and the automotive toy 40 is stopped.

As described above, while an automotive toy is passing the intersection portion, the other automotive toy which approaches the intersection in the other direction is prohibited from entering the intersection portion in this embodiment. Accordingly, the automotive toys can be prevented from colliding on the intersection portion. The running direction of the automotive toys can be suitably changed over on the point.

The shape and the number of the automotive toys driven on the running way 10 can be arbitrarily selected. For example, toy motorcycles or toy animals are possible.

The shape of the running ways on which the automobile toys move is also selected arbitrarily. For example, the waiting way 15 may be branched from the straight running way 12*a*.

The shape of the blocks 65 and 66 is not limited to that of the blocks according to the embodiments of the present invention. For example, the profile of the portion of each of the blocks 65 and 66 ranging from the tip end to the part fixed to the rotary body 67 may be formed into an arcuate shape.

The number of the running ways forming the intersection portion and the shape thereof are also arbitrary. For example, three arcuate running ways may be connected to form a fork shape at their junction.

The control of the change-over of the running directions and stopping of the automotive toys is not limited to remote control. For example, the change-over of the running directions of the automotive toys 40 and 41 can be performed by using change-over switches provided on lateral sides of the toys 40 and 41. The control may be performed by wireless control.

One or more lanes can be used, i.e., one lane, two lanes, three lanes or more than three lanes are possible.

Second Embodiment

While an automobile toy is passing the intersection portion, the other automobile toy is prohibited mechanically from entering the intersection by means of the rotation control unit 63 in the first embodiment of the present invention. The control of the change-over of the moving directions of the automotive toys and entrance of the automotive toys into the intersection and stopping of the automobile toys can be performed by means of electronic control using hardware and software, which will be described as a second embodiment as follows.

Figure 20:
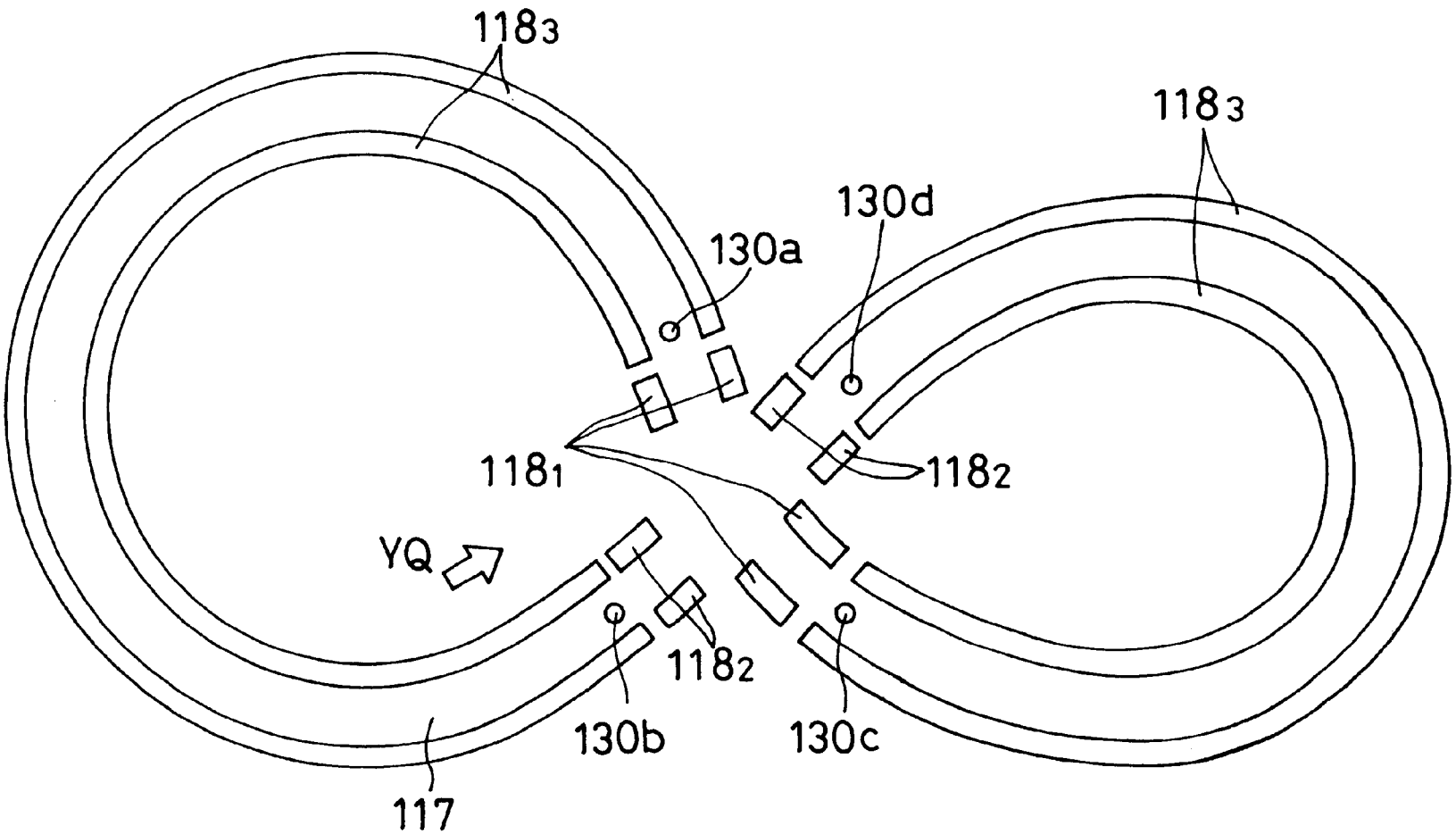
FIG. 20 is a plan view of a second embodiment of an intersection control system for automotive toys according to the present invention.

The fundamental structure of the second embodiment is the same as that of the first embodiment. Only one exception is that one lane is used. The structure of a guide 117 according to the second embodiment is shown in FIG. 20.

Electric power supplying rails 118 are provided on both sides of the guide lane 117. The portions of the electric power supplying rails $\mathbf{118}_1$ and $\mathbf{118}_2$ which are close to an intersection portion 60 is electrically insulated from the other electric power supplying rails $\mathbf{118}_3$.

The guide lane 117 connected to the intersection portion 60 are provided with sensors 130*a* to 130*d* for detecting the movement of the automotive toys.

Figure 21:
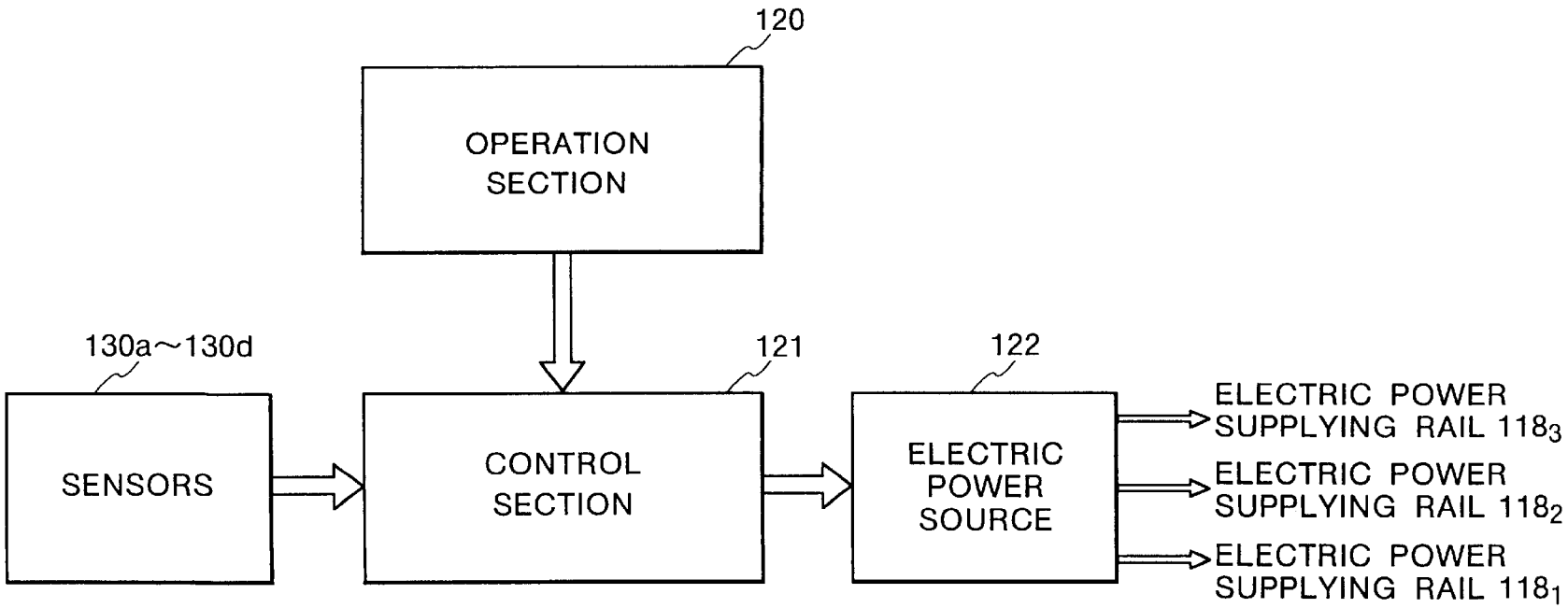
FIG. 21 is a block diagram illustrating the operation of the intersection control system as shown in FIG. 20.

FIG. 21 shows a circuit block diagram for controlling the movement of the automotive toys.

As illustrated in FIG. 21, a control circuit comprises an operation section 120, a control section 121, an electric power source 122 and sensors 130*a* to 130*d*. The operation section 120 outputs instructions of any of the forward movement, rearward movement or stop of the automotive toys to the control section 121. To the electric power supplying rails $\mathbf{181}_1$, $\mathbf{181}_2$ and $\mathbf{181}_3$, the electric power source 122 applies forward movement voltage or rearward movement voltage according to the moving directions of the automotive toys.

Operation of the second embodiment will now be described with reference to FIGS. 20 and 21.

When the forward movement of the related automotive toy is instructed by the operation section 120 to the control section 121, the control section 121 acts to apply the voltage for moving the related automotive toy (not shown) forward to the electric power supplying rails $\mathbf{118}_1$ to $\mathbf{118}_3$. A motor housed in the automotive toy is rotated in the reverse direction according to the voltage applied from the electric power supplying rail 118, thereby moving the automotive toy forward.

Upon the instruction of the rearward movement of the related automotive toy from the operation section 120, the control section 121 is operated to apply the voltage for moving the related automotive toy rearward to the electric power supplying rails $\mathbf{118}_1$ to $\mathbf{118}_3$. The motor housed in the automotive toy is rotated reverse due to the voltage applied from the electric power supplying rails $\mathbf{118}_1$ to $\mathbf{118}_3$.

As the automotive toy moves forward or rearward and approaches the intersection portion, the sensors 130*a* to 130*d* detect the movement and output interrupt signals to the control section 121.

In response to the interrupt signals, the control section 121 commences the control for preventing the automotive toys from colliding on the intersection portion.

First, the control section 121 specifies the sensor which has outputted the interrupt signals and also specifies the electric power supplying rail which is perpendicular to the guide lane 117 on which the specified sensor is provided.

The control section 121 outputs the instruction to the electric power source 122 to stop the supply of the electric power to the electric power supplying rail having the sensor which has outputted the interrupt signal. Thus, the automotive toy to which the electric power has been supplied from the electric power supplying rail $\mathbf{118}_2$, for example, is stopped.

Next, the control section 121 discriminates from the outputs of the sensors 131*a* to 131*d* whether or not the automotive toy detected by the sensor has passed the intersection portion 60. If the automotive toy has not yet passed the intersection portion 60, the control section 121 waits until the former automotive toy has passed the intersection portion 60.

After the automotive toy has passed the intersection portion, the control section 121 sends instruction to restart the electric power supply to the electric power supplying rail to which the electric power supply has been interrupted.

When an automotive toy moves in the direction of the arrow YQ in FIG. 20 and the sensor 130*b* outputs the interrupt signal, the control section 121 causes the electric power source 122 to stop the supply of the electric power of the electric power source 122 to the electric power supplying rail $\mathbf{118}_2$. Thus, the other automotive toy is not supplied with the electric power from the electric power supplying rail $\mathbf{118}_2$ and cannot enter the intersection portion. Next, the control section 121 waits until the sensor 130*d* outputs the detected signal. When the sensor 130*d* outputs the detected signal, the control section 121 restarts the supply of the electric power to the electric power rail $\mathbf{118}_2$.

This structure can also prevent the automotive toy from colliding on the intersection portion.

Any alterations and modifications are also possible to the second embodiment.

What is claimed is:

1. An intersection apparatus for automotive toys comprising:

a first way on which one automotive toy runs;

a second way which intersects with the first way and on which another automotive toy runs;

an intersection portion at which the first and second ways intersect with each other; and an entrance control mechanism which stops the another automotive toy when the one automotive toy is in the intersection portion on one of the first and second ways;

wherein each of the first and second ways includes a first lane and a second lane, the entrance control mechanism has a plurality of blocks rotatable around a center of the intersection portion and are arranged on the first and the second ways in a normal condition, the plurality of blocks have inclining side faces and stoppers, the inclining side faces being placed on the first and the second lanes and the stoppers are placed on portions other than the first and second lanes when the blocks are in a normal condition, and the blocks are able to rotate when one of the inclining side faces is pressed by an automotive toy running on one of the first and the second lanes to open the one of the first and the second lanes and to place the stoppers on other of the first and the second lanes so that an automotive toy running the other of the first and the second lanes are stopped by the stoppers located on the other of the first and the second lanes.

2. The intersection apparatus according to claim 1, further comprising an urging member for urging the blocks toward a standard position.

3. The intersection apparatus according to claim 2, wherein each of the stoppers stops the another automotive toy which does not rotate the blocks even if the stoppers are pressed, and each of the blocks transfers the stoppers to the other of the first and the second lanes, upon rotation of the blocks.

4. The intersection apparatus according to claim 1, wherein the plurality of blocks include:

a first block which has a stopper in the front end portion and two inclining side faces elongated from both sides of the stopper, and a second block including two members each having a stopper in a front end portion and an inclining side face elongated from one end of the stopper, the inclining side faces of the members facing with each other, and the first block is arranged on one side of said first and second ways, and the second block is arranged on opposing sides of said first and second ways, thereby the intersection portion sandwiched therebetween.

5. The intersection apparatus according to claim 1 further comprising a rotary body, and wherein:

the blocks comprise four blocks formed integral with the rotary body, the four blocks extend radially outward from the rotary body so as to form a cross body, each of a first and a second block includes a substantially rhombus block having a thin distal end and a proximal end and a central portion having a width substantially equal to a width of the first and second ways and the thin distal end functions as the stopper, each of a third and a fourth block has a width substantially equal to the width of the first and second ways and a groove for allowing an automotive toy to pass therethrough, and the first and third blocks are substantially extending along a straight line and the second and fourth blocks are substantially extending along a straight line.

6. A toy track for automobile toys comprising:

a first way;

a second way which intersects with the first way; and a controller which stops one automotive toy which is approaching an intersection of the first and second ways, while another automotive toy is passing through the intersection;

wherein each of the first and second ways includes a first lane and a second lane, the controller has a plurality of blocks rotatable around a center of the intersection and are arranged on the first and second ways in a normal condition, each block has an inclined side face, each block also has a stopper which stops the one automotive toys which is approaching the intersection;

the blocks are able to rotate when one of the inclining side faces is pressed by an automotive toy running on one of the first and second lanes to open the one of the first and second lanes and to place the stoppers on other of the first and second lanes so that another automotive toy running the other of the first and second lanes is stopped by the stoppers moved into the other of the first and second lanes.

7. The toy track according to claim 6, wherein the controller comprises:

opening means which is pushed by the another automotive toy entering the intersection and opens the running lane of the another automotive toy after all other toys have exited the intersection.

8. The toy track according to claim 6, further including circulating way connecting the first way to the second way.

9. The toy track according to claim 6, further comprising a branch way branched from the first way at a branch portion and a point provided between the first way and the branch way at the branch portion for leading an automotive toy which is running on the first way to the branch way or for causing an automotive toy traveling in the opposite direction to continue to run on the first way beyond the branch portion.

10. The toy track according to claim 9, wherein the point includes a point member which can project from and be retracted in the branch portion and which has a lateral wall connecting the branch way to the first way, the point member acting such that:

(1) when one automotive toy is running on the branch way, the lateral wall of the point member is pushed by the one automotive toy on the branch way whereby the point member leads the one automotive toy to the first way;

(2) when one automotive toy is running on the first way in a first direction, the lateral wall of the point member is pushed by the one automotive toy on the first way whereby the point member leads the one automotive toy to the branch way; and (3) when one automotive toy is running on the first way in a second direction, the point member is depressed in the branch portion by a pressure of the automotive toy on the first way to allow the one automotive toy to pass the point member.

11. The point apparatus according to claim 10, wherein the point member is urged upwardly, and has an inclined face, and an automotive toy running in a first direction on the way goes on the inclined face, so that the automotive toy presses the point member downwardly and the point member is retraced, thereby the automotive toy continues running in the first direction.

12. A point apparatus for automotive toys comprising:

a way on which an automotive toy runs;

at least one branch portion formed on the way;

a branch way branched from the way at the branch portion; and a point includes a point member which can project from and be retracted in the branch portion and which has a lateral wall connecting the branch way to the way;

wherein the point member acts such that:

(1) when one of the automotive toys is running on the branch way, the lateral wall of the point member is pushed by the one automotive toy on the branch way whereby the point member leads the one automotive toy to the way;

(2) when one of the automotive toys is running on the way in a first direction, the lateral wall of the point member is pushed by the automotive toy on the way whereby the point member leads the one automotive toy to the branch way; and (3) when one of the automotive toys is running on the way in a second direction, the point member is retracted in the branch portion by a pressure of the one automotive toy on the way to allow the one automotive toy to pass the point member.

13. The point apparatus according to claim 12, wherein the point member can project from and be retracted in the branch portion and which has a lateral wall connecting the branch way to the way and a slope onto which the automotive toy when running on the way in a second direction, the point member is retracted in the branch portion by a pressure of the one automotive toy on the way to allow the one automotive toy to pass the point member.

14. The point apparatus according to claim 12, wherein the point member is urged upwardly, and has an inclined face, and an automotive toy running in a first direction on the way goes on the inclined face, so that the automotive toy presses the point member downwardly and the point member is retraced, thereby the automotive toy continues running in the first direction.

* * * * *